US005717410A

United States Patent [19]

Ohmine et al.

[11] Patent Number: 5,717,410

[45] Date of Patent: Feb. 10, 1998

[54] OMNIDIRECTIONAL SLOT ANTENNA

[75] Inventors: Hiroyuki Ohmine; Yonehiko Sunahara; Shin-ichi Sato; Takashi Katagi; Shusou Wadaka, all of Kanagawa-ken, Japan

[73] Assignee: Mitsubishi Denki Kabushiki Kaisha, Tokyo, Japan

[21] Appl. No.: 340,153

[22] Filed: Nov. 15, 1994

[30] Foreign Application Priority Data

May 20, 1994 [JP] Japan ..... 6-107166

[51] Int. Cl.[6] ..... H01Q 13/10

[52] U.S. Cl. ..... 343/771; 343/767; 343/770

[58] Field of Search ..... 343/767, 770, 343/771, 773, 783, 890, 891, 873

[56] References Cited

U.S. PATENT DOCUMENTS

| | | | |
|---|---|---|---|
| 2,660,674 | 11/1953 | Brown | 343/770 |
| 2,771,605 | 11/1956 | Kirkman | 343/773 |
| 2,785,399 | 3/1957 | Harris | 343/873 |
| 2,818,565 | 12/1957 | Ajioka et al. | 343/767 |
| 3,656,166 | 4/1972 | Klopach et al. | 343/773 |
| 3,680,130 | 7/1972 | Jones et al. | 343/770 |
| 3,757,290 | 9/1973 | Ross et al. . | |
| 3,829,863 | 8/1974 | Lipsky | 343/773 |
| 4,143,377 | 3/1979 | Salvat et al. | 343/773 X |
| 4,247,858 | 1/1981 | Eichweber . | |
| 4,387,377 | 6/1983 | Kandler . | |
| 4,388,388 | 6/1983 | Kornbau et al. . | |
| 4,451,830 | 5/1984 | Lucas et al. . | |
| 4,590,479 | 5/1986 | Ben-Dov . | |
| 4,763,130 | 8/1988 | Weinstein | 343/770 |
| 4,914,449 | 4/1990 | Fukuzawa et al. . | |
| 4,922,259 | 5/1990 | Hall et al. . | |
| 5,103,241 | 4/1992 | Wu . | |
| 5,134,420 | 7/1992 | Rosen et al. | 343/773 X |

FOREIGN PATENT DOCUMENTS

| | | | |
|---|---|---|---|
| 0151705 | 9/1983 | Japan | 343/767 |
| 58-181303 | 10/1983 | Japan . | |
| 0055603 | 3/1984 | Japan | 343/767 |
| 0180205 | 9/1985 | Japan | 343/767 |
| 6140829 | 5/1994 | Japan . | |
| 2067842 | 7/1981 | United Kingdom . | |
| 2142475 | 1/1985 | United Kingdom . | |
| 2221577 | 2/1990 | United Kingdom . | |

OTHER PUBLICATIONS

H. Uchida & Y. Mushiake "Ultrashort–Wave Antennas", Mar., 1977, Chapter 12.

T. Takeshima "X–band Omnidirectional Double–Slot Array Antenna", Kobe Industries Corporation Akashi, Japan Electric Engineering Oct. 1967 pp. 617–621.

Claude Vergnolle, Thierry Lemoine & Bernard Dumont "Materials Requirements for Microwave Antenna Into Aircraft Skins" SPIE vol. 1916/197.

*Primary Examiner*—Donald T. Hajec
*Assistant Examiner*—Tho Phan
*Attorney, Agent, or Firm*—Wolf, Greenfield & Sacks, P.C.

[57] ABSTRACT

There is provided a small-sized and simplified horizontally polarized antenna apparatus which forms an omnidirectional pattern in the horizontal plane. The radiation field in the horizontal plane becomes continuous and a horizontally polarized omnidirectional radiation pattern can be obtained in the horizontal plane by forming radiation slots at opposing positions on a grounded hollow body and exciting the slots out of phase.

28 Claims, 27 Drawing Sheets

OMNIDIRECTIONAL SLOT ANTENNA

BACKGROUND OF THE INVENTION

1. Field of the Invention

The present invention relates to a horizontally polarized antenna apparatus which has an omnidirectional pattern in the horizontal plane, and to a transponder provided with such an antenna apparatus.

2. Prior Art

FIGS. 1(*a*) and 1(*b*) schematically illustrate a configuration of a horizontal polarized antenna apparatus which has an omnidirectional pattern in the horizontal plane explained in Chapter 12 of "VHF Antenna" written by Uchida and Mushiake, and issued by the Production Technology Center (March, 1977). FIG. 1(*a*) is a perspective view and FIG. 1(*b*) is a top plan view with electric field distribution indicated by arrows.

In these figures, the numeral 50 designates a dipole antenna and the symbol I indicates a current flowing through the dipole.

Next, operations will be explained. A grounded conductor 51 includes four surfaces and a dipole antenna 50 is arranged at each surface. The dipole antenna 50 is arranged in parallel to the horizontal surface to excite a horizontally polarized wave. A plurality of dipole antennas may be arranged in the vertical direction. Amplitudes of currents flowing through the dipole antennas in the same height are equal, but phases thereof are sequentially different by 90 degrees. A dipole antenna 50 has a figure-8 type radiation directivity, but substantially horizontally polarized omnidirectivity can be obtained through a combination of the four dipole elements.

FIGS. 2(*a*)–2(*c*) show a conventional slot antenna indicated in "X-band omnidirectional double-slot array antenna" by T. Takeshima, ELECTRONIC ENGINEERING, No. 39, pp. 617–621 (October, 1967).

These figures schematically illustrate a configuration of a horizontally polarized antenna apparatus which has an omnidirectional pattern in the horizontal plane (rectangular waveguide slot antenna). FIG. 2(*a*) is a perspective view, FIG. 2(*b*) is a sectional view along the line A—A and FIG. 2(*c*) is a side elevation.

In FIGS. 2(*a*)–2(*c*), numeral 60 designates a radiation slot; 61 a waveguide; and 62 a flange.

The principle in operation of the rectangular waveguide slot antenna shown in FIGS. 2(*a*)–2(*c*) will be explained with reference to FIGS. 3(*a*) and 3(*b*). FIG. 3(*a*) is a diagram illustrating a distribution of magnetic field inside the waveguide 61. FIG. 3(*b*) is a cross-sectional view along the line A—A illustrating a distribution of magnetic field inside the waveguide and a current flowing along the side surface.

Such distributions of magnetic field and current as illustrated in FIGS. 3(*a*) and 3(*b*) can be realized by short-circuiting the end portions of the waveguide. Electromagnetic waves propagated along the rectangular waveguide 61 excite the radiation slots 60 to radiate electromagnetic waves if the radiation slots 60 are provided in parallel with the waveguide axis at the positions offset from the center of the H plane of the rectangular waveguide 61.

In this case, the radiation slots 60 are excited by providing each of the radiation slots 60 at a position where the magnetic field inside the waveguide 61 becomes maximum. An amount of electromagnetic wave radiation can be adjusted by changing the position of each radiation slot 60.

In order that the waveguide slot antenna shown in FIGS. 2(*a*)–2(*c*) may be used as a horizontally polarized omnidirectional antenna, the radiation slots 60 are provided, as shown in FIG. 4(*a*), on the front and rear H planes of the waveguide 61. Then, a distribution of electric field in the horizontal plane changes as shown in FIG. 4(*b*). The radiation slots 60 are excited out of phase and the radiation field becomes continuous in the horizontal plane. As a result, a theoretically omnidirectional directivity can be realized.

However, if, as shown in FIG. 2(*a*), two radiation slots are formed symmetrically on the front and rear surfaces, two radiation slots can be excited in the same phase by arranging the radiation slots in symmetrical positions of the waveguide 61 with respect to the center thereof at an interval of $\lambda g/2$ ($\lambda g$ is a wavelength in the waveguide).

Therefore, a vertically symmetrical pattern can be obtained in the direction of $\phi=\pm 90°$ (in FIG. 4(*a*)), while a beam tilt is generated in the direction of $\theta=90°+\alpha$ and $\theta=0°$ and 180° in FIG. 4(*a*) due to an array factor of the radiation field of the two radiation slots.

Accordingly, on the x-y plane, a gain difference is generated in the direction of $\chi=\pm 90°$, 0° and 180° and a ripple in the horizontal plane becomes significant whereby no omnidirectivity can be achieved.

In the case where one radiation slot is provided in a position offset from the center of the H plane of the waveguide, no symmetrical configuration is not formed and actually no omnidirectivity can be obtained.

FIG. 5 schematically illustrates a configuration of a transponder 70 provided with an antenna 71 shown in FIG. 2(*a*). This transponder 70 is provided with a transmitter/receiver (transceiver) 72 connected to the horizontally polarized antenna 71 which has an omni-directional pattern in the horizontal plane. In an emergency such as an accident, the transceiver 72 is activated by turning a switch 73 ON, getting the transceiver ready for receiving a signal. When the transceiver 72 under this condition receives a radar signal radiated from a searching plane, the transceiver 72 is switched to an electromagnetic wave radiation mode and transmits a response signal. Thus, a person who has met with an accident can inform his position by generating an emergency signal and await rescue by a searching plane. The transceiver 72 is connected to a battery 74 and the transponder 70 is covered with a radome 75.

An existing horizontally omnidirectional antenna structured such as explained above is widely used as an antenna apparatus for TV and radar.

However, if a dipole antenna as shown in FIG. 1(*a*) is used, the apparatus itself has protrusions having large volumes and there is a difficulty in fixing the antenna and wiring power supply cables.

If a waveguide slot antenna as shown in FIG. 2(*a*) is used, a substantially omnidirectional pattern can easily be achieved by providing radiation slots on the waveguide, but, if a ripple in the horizontal plane becomes large, any omnidirectional pattern cannot be obtained.

Meanwhile, a conventional transponder has the following problems in practical use. First, it is necessary to place the transponder in a waiting mode by turning ON the switch, but, in an emergency case, a user sometimes forgets to turn ON the power switch. In this case, the transponder does not function, thereby endangering a user's life.

Moreover, the transceiver, which normally transmits a signal upon reception of a radar signal radiated from a searching plane, has no means for indicating which condition the apparatus is in. For example, it is unclear whether the transceiver is sometimes inoperative and does not perform transmission even when the switch is turned ON.

In addition, it is also impossible to detect, while a signal is transmitted from the transponder, whether a searching plane is coming closer.

SUMMARY OF THE INVENTION

The present invention has been proposed to overcome the problems described above and it is therefore an object of the present invention to provide a small-sized horizontally polarized omnidirectional antenna having a simplified configuration.

Moreover, it is a further object of the present invention to provide a transponder comprising an omnidirectional horizontally polarized antenna and capable of notifying an operator who has issued an emergency signal that the apparatus is activated and in a waiting mode, that the apparatus is then in a transmission mode and that a searching plane is coming closer.

In order to achieve the objects described above, according to an aspect of the present invention, there is provided an antenna apparatus where radiation slots are arranged at opposite position on a grounded conductive hollow body and the radiation slots are excited out of phase to form an omnidirectional radiation pattern in a plane perpendicular to the hollow body.

The hollow body is a rectangular hollow body formed of conductive plates and the slots are formed on the opposing the conductive plates and excited out of phase through a signal feeding line.

Since the slots are excited out of phase, the electrical field radiated from the radiation slots becomes continuous in a plane perpendicular to the hollow body, for instance, in the horizontal plane and therefore an omnidirectional radiation pattern can be obtained in the horizontal plane.

The hollow body may be filled with a dielectric material whereby the antenna apparatus can be manufactured in a small size due to a wavelength shortening effect of the dielectric material.

It is possible to make a through-hole in the dielectric material between the radiation slots. Since the radiation slots become longer to thereby resonate at the same frequency, a beam width becomes narrow in the plane perpendicular to the hollow body and a gain can be increased.

The signal feeding line and the radiation slots may be electromagnetically coupled with each other such that the radiation slots are excited out of phase with the signal feeding line.

A plurality of radiation slots may be provided along the longitudinal axis of the hollows body. In this case, the radiation slots formed on the opposing conductive plates are excited out of phase and the radiation slots formed on the same conductive plate are excited in phase. Consequently, a beam width in a plane including the longitudinal axis can be narrowed and a gain can be increased. In this case, a difference in length of signal feeding lines used to feed the adjacent radiation slots on the same conductive plate can be set to integer times an operating wavelength or odd number of times a half of the operating wavelength.

At least one conductive bar can be provided around the radiation slots to connect the opposing conductive plates, whereby any unwanted waveguide mode can be suppressed.

It is possible to provide horn-type conductive plates on the conductive plates perpendicular to the longitudinal axis of the hollow body. The horn-type conductive plates enable a beam width in a plane including the longitudinal axis to be reduced without changing the size and position of the radiation slots and an omni-directional high-gain radiation pattern to be achieved in the plane perpendicular to the longitudinal axis.

Semi-cylindrical conductive plates may be provided to the conductive plates which have no radiation slots, whereby any influence of waves diffracted at the edges of the conductive plates can be avoided, an amount of ripple in the plane perpendicular to the longitudinal axis can be adjusted and an omnidirectional radiation pattern can be obtained without changing size and position of the slots.

The signal feeding lines can be provided to the outer surfaces of dielectric layers formed on the opposing conductive plates.

According to another aspect of the present invention, the hollow body can be a cylindrical hollow body having at least one radiation slot formed along the longitudinal axis of the cylindrical body and a conductive bar fixed inside the cylindrical body to one side edge of the radiation slot.

The cylindrical body can be excited in the $TE_{01}$ mode, whereby the radiation slot can be excited without using the conductive bar and an omnidirectional radiation pattern can be obtained.

The conductive cylindrical body can be provided with a center conductor. This center conductor can be a spiral conductor. Since a current flows through the outer conductor at a slanting angle with respect to the longitudinal axis of the cylindrical body, the radiation slots provided along the longitudinal axis can be excited and an omnidirectional radiation pattern can be obtained in a plane perpendicular to the longitudinal axis.

Horn-type conductive plates can be provided on the respective surfaces perpendicular to the longitudinal axis of the conductive cylindrical body. The horn-type conductive plates enables a beam width in a plane including the longitudinal axis to be reduced without changing size and position of the radiation slots and a high gain omnidirectional radiation pattern to be obtained in the plane perpendicular to the longitudinal axis.

According to a further aspect of the present invention, the hollow body is a rectangular waveguide having radiation slots formed on the center line of the H planes of the rectangular waveguide and a member for disturbing a distribution of electromagnetic field inside the rectangular waveguide.

The member can comprise conductive bars fixed to one side edge of a corresponding radiation slot or can be a dielectric material mounted at a position deviated from the center line of the rectangular waveguide. The conductive bars and the dielectric material operate to distribute an electromagnetic field in the rectangular waveguide a symmetrically with respect to the center line, whereby the radiation slots provided on the center line of the H planes are excited and an omnidirectional radiation pattern having no beam tilt can be obtained. Meanwhile, it is also possible to excite the rectangular waveguide in the $TE_{20}$ mode, in place of providing the above electromagnetic field disturbing member in the rectangular waveguide. Since the electric field becomes zero along the center line of the H plane, the radiation slots provided on the center line of the H planes can be excited out of phase and thereby an omnidirectional radiation pattern can be obtained in a plane perpendicular to the longitudinal axis of the rectangular waveguide.

According to still another aspect of the present invention, there is provided an antenna apparatus comprising a pair of microstrip antennas each having a first patch conductor one end of which is short-circuited to a grounded conductive plate. The grounded conductive plates are arranged back to back in parallel with each other and the first patch conductors are excited out of phase with each other. Since an electric field formed by the pair of microstrip antennas becomes continuous in the azimuth direction, an omnidirectional radiation pattern can be obtained. It is possible that non-excited second patch conductors of the same shape are provided facing the first patch conductors. This makes the antenna apparatus symmetrical thereby improving the directivity.

According to a still further aspect of the present invention, there is provided an antenna apparatus comprising a grounded conductive plate and a pair of patch conductors provided on both sides of and in parallel to the conductive plate. An outer edge of each patch conductor is electrically connected to a corresponding outer edge of the conductive plate, and these patch conductors are excited out of phase with each other. This type of antenna apparatus forms a continuous radiation field in a plane perpendicular to the conductive plate, an omnidirectional radiation pattern can be obtained.

It is advisable for an inner conductor of a coaxial line to be connected to the conductive plate and an outer conductor to the patch conductors, so that the patch conductors are excited out of phase with each other. As a result, a signal feeding circuit can be simplified.

The antenna apparatus of the present invention can be installed in a radome comprising a conductive film formed on a dielectric body and a plurality of radiation slots formed on the conductive film to be disposed in the same direction as the radiation slots of the antenna apparatus. The radome serves to protect the antenna apparatus and reradiate an electromagnetic wave through the radome, thereby forming an omnidirectional radiation pattern.

The present invention proposes a transponder comprising an omnidirectional antenna such as any one of the above-described antenna apparatuses according to the present invention, a radome for protecting the antenna, a transceiver connected to the antenna and a switch for controlling the transceiver. The transceiver can be provided with an indicator for indicating that the transponder is waiting for a signal from a searching plane. This assures motivation for turning ON the switch. The transceiver can also be provided with an indicator for indicating that the transponder is transmitting a signal. The transceiver can also be provided with an indicator for indicating a level of a received signal. This enables a distance from a searching plane to be detected.

The above and further objects and features of the present invention will be more clearly understood from a consideration of the following description taken in connection with the accompanying drawings.

BRIEF DESCRIPTION OF THE DRAWINGS

FIG. 1(*b*) is a plan view of the antenna apparatus of FIG. 1(*a*), illustrating a distribution of electric field.

FIG. 2(*b*) is a cross-sectional view taken along the line A—A of FIG. 2(*a*). FIG. 2(*c*) is a side elevation of the antenna apparatus of FIG. 2(*a*).

FIG. 3(*b*) illustrates directions of current and magnetic field at the cross-section taken along the line A—A of FIG. 3(*a*).

FIG. 4(*b*) illustrates a horizontal distribution of electric field established by the antenna apparatus of FIG. 4(*a*).

FIG. 6(*b*) is a cross-sectional view taken along the line A—A of FIG. 6(*a*). FIG. 6(*c*) is a cross-sectional view taken along the line B—B of FIG. 6(*a*).

FIG. 9(*b*) is a cross-sectional view taken along the line A—A of FIG. 9(*a*). FIG. 9(*c*) is a cross-sectional view taken along the line B—B of FIG. 9(*a*).

FIG. 10(*b*) is a cross-sectional view taken along the like A—A of FIG. 10(*a*). FIG. 10(*c*) is a cross-sectional view taken along the line B—B of FIG. 10(*a*).

FIG. 11(*b*) is a cross-sectional view taken along the line A—A of FIG. 11(*a*). FIG. 11(*c*) is a cross-sectional view taken along the line B—B of FIG. 11(*a*).

FIG. 12(*b*) is a cross-sectional view taken along the line A—A of FIG. 12(*a*). FIG. 12(*c*) is a cross-sectional view taken along the line B—B of FIG. 12(*a*).

FIG. 13(*b*) is a cross-sectional view taken along the line A—A of FIG. 13(*a*). FIG. 13(*c*) is a cross-sectional view taken along the line B—B of FIG. 13(*a*).

FIG. 14(*b*) is a cross-sectional view taken along the line A—A of FIG. 14(*a*).

FIG. 15(*b*) is a side elevation of the antenna apparatus of FIG. 15(*a*).

FIG. 16(*b*) is a cross-sectional view taken along the line A—A of FIG. 16(*a*). FIG. 16(*c*) is a side elevation of the antenna apparatus of FIG. 16(*a*).

FIG. 17(*b*) is a cross-sectional view taken along the line A—A of FIG. 17(*a*). FIG. 17(*c*) is a side elevation of the antenna apparatus of FIG. 17(*a*).

FIG. 18(*b*) is a cross-sectional view taken along the line A—A of FIG. 18(*a*). FIG. 18(*c*) is a side elevation of the antenna apparatus of FIG. 18(*a*).

FIG. 19(*b*)

illustrates a distribution of electromagnetic field at the cross-section taken along the line A—A of FIG. 19(*a*). FIG. 19(*c*) illustrates a distribution of a current on the side surface of the antenna apparatus of FIG. 19(*a*).

FIG. 20(*b*) is a cross-sectional view taken along the line A—A of FIG. 20(*a*). FIG. 20(*c*) is a side elevation of the antenna apparatus of FIG. 20(*a*).

FIG. 21(*b*) is a cross-sectional view taken along the line A—A of FIG. 21(*a*). FIG. 21(*c*) illustrates a distribution of a current at the cross-section taken along the line A—A of FIG. 21(*a*).

FIG. 22(*b*) illustrates a distribution of electric field at the cross-section taken along the line A—A of FIG. 22(*a*).

FIG. 24(*b*) is a cross-section taken along the line A—A of FIG. 24(*a*).

FIG. 25(*b*) is a cross-section taken along the line A—A of FIG. 25(*a*).

FIG. 26(*b*) is a cross-section taken along the line A—A of FIG. 26(*a*).

FIG. 27(*b*) is a cross-sectional view taken along the line A—A of FIG. 27(*a*). FIG. 27(*c*) is a side elevation of the antenna apparatus of FIG. 27(*a*).

In the drawings, the same numerals designate similar or corresponding elements.

DESCRIPTION OF THE PREFERRED EMBODIMENTS

Embodiment 1

Figure 1A:
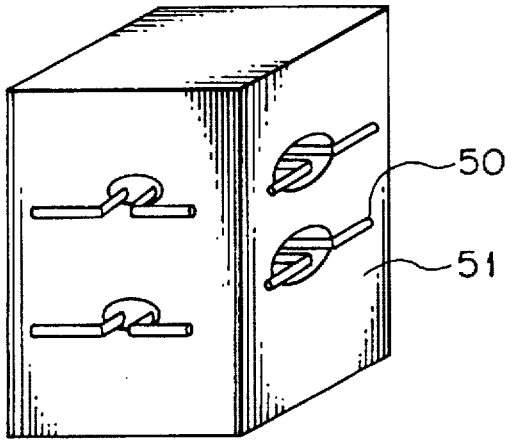
Fig. 1(a) PRIOR ART
FIG. 1(*a*) is a perspective view of a conventional omnidirectional antenna apparatus.
Figure 1B:
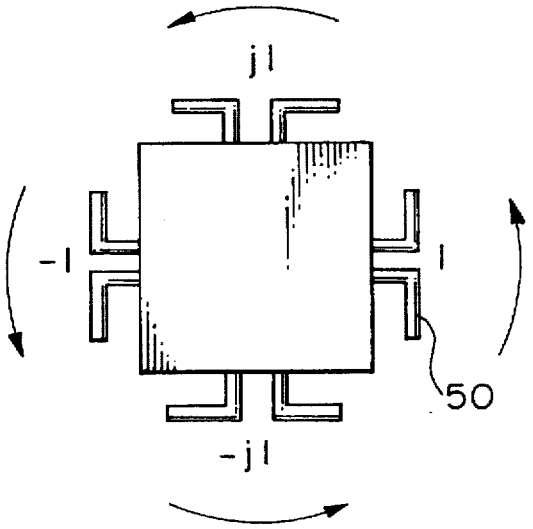
Fig. 1(b) PRIOR ART
Figure 2A:
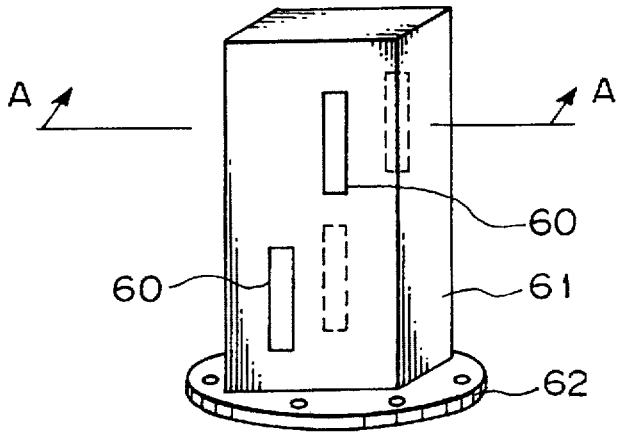
Fig. 2(a) PRIOR ART
FIG. 2(*a*) is a perspective view illustrating another conventional omnidirectional antenna apparatus.
Figure 2B:
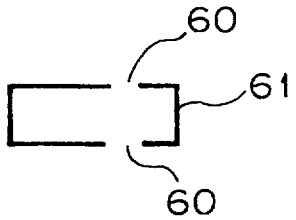
Fig. 2(b) PRIOR ART
Figure 2C:
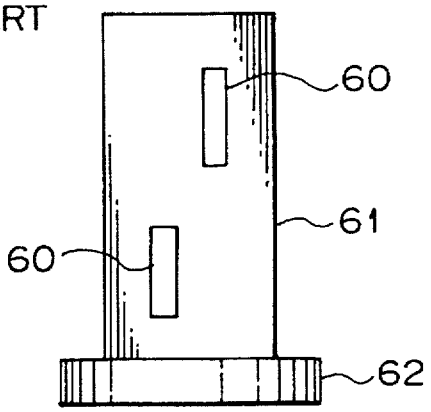
Fig. 2(c) PRIOR ART
Figure 3A:
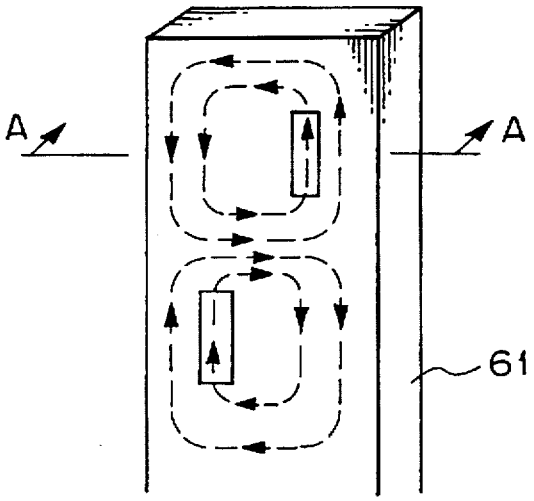
Fig. 3(a) PRIOR ART
FIG. 3(*a*) illustrates a distribution of magnetic field in the antenna apparatus of FIG. 2(*a*).
Figure 3B:
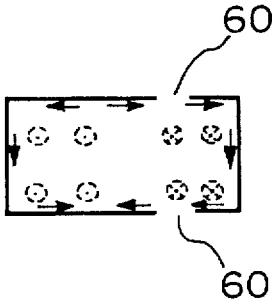
Fig. 3(b) PRIOR ART
Figure 4A:
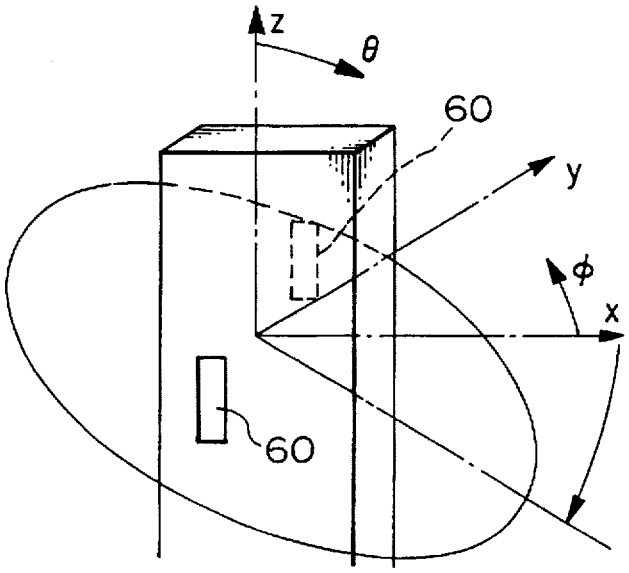
Fig. 4(a) PRIOR ART
FIG. 4(*a*) is a diagram for explaining directivity of the antenna apparatus of FIG. 2(*a*).
Figure 4B:
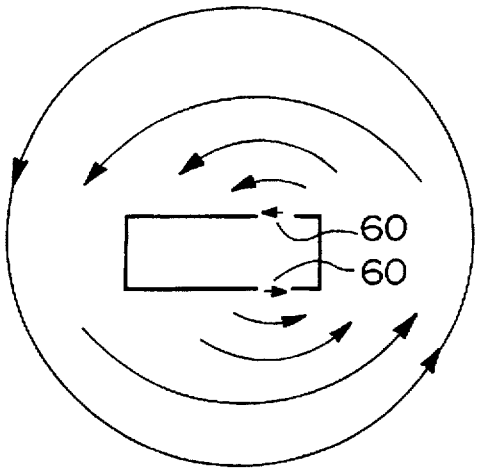
Fig. 4(b) PRIOR ART
Figure 5:
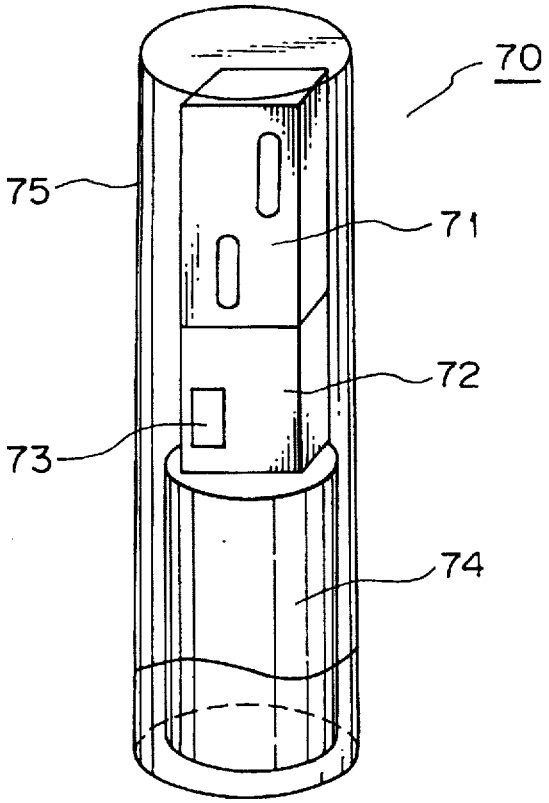
Fig. 5 PRIOR ART
FIG. 5 is a partially cutout diagram illustrating a conventional transponder.
Figure 6A:
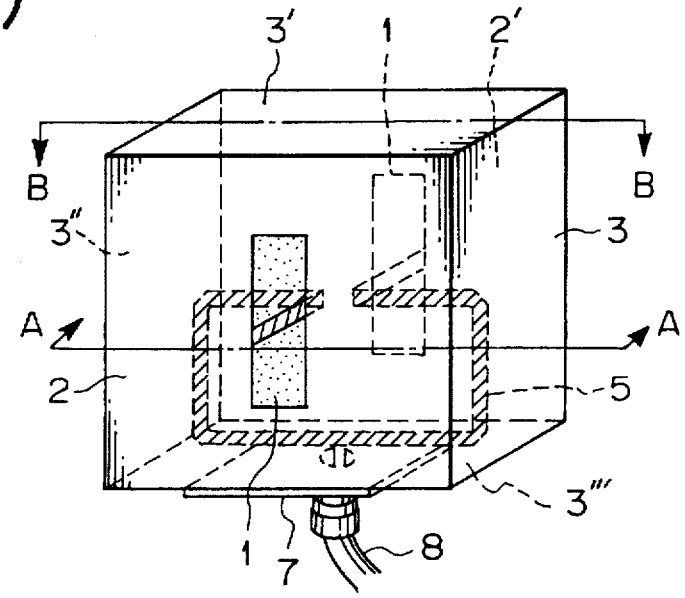
FIG. 6(*a*) is a perspective view of a first embodiment of an antenna apparatus of the present invention.
Figure 6B:
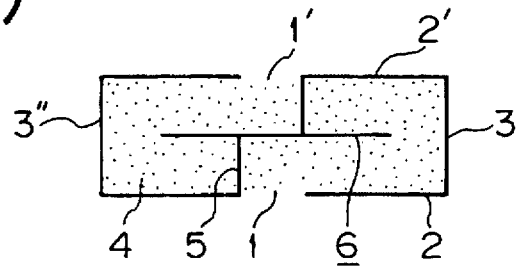
Figure 6C:
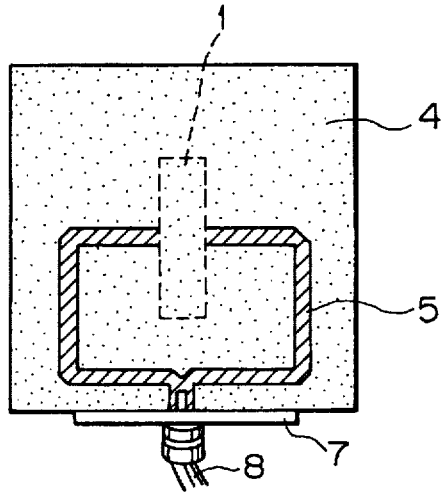

FIGS. 6(*a*)–6(*c*) schematically illustrate a configuration of the first embodiment of the present invention, FIG. 6(*a*) being a perspective view, FIG. 6(*b*) cross-sectional view taken along the line A—A of FIG. 6(*a*) and FIG. 6(*c*) a cross-sectional view taken along the line B—B of FIG. 6(*a*).

In these figures, radiation slots 1, 1' are formed respectively on a first set of parallel conductive plates 2, 2' and both conductive plates 2, 2' are connected by a second set of conductive plates 3', 3", 3'" to configurate a rectangular parallelepiped. The inside of the rectangular parallelepiped is filled with a dielectric material 4. The radiation slots 1, 1' are excited by a triplate line 6 formed of the conductive plates 2, 2' and strip lines 5. Numeral 7 designates a coaxial connector for feeding the triplate line; and 8 a coaxial line. The conductive plates 2, 2', 3, 3', 3", 3'" are grounded.

Figure 7:
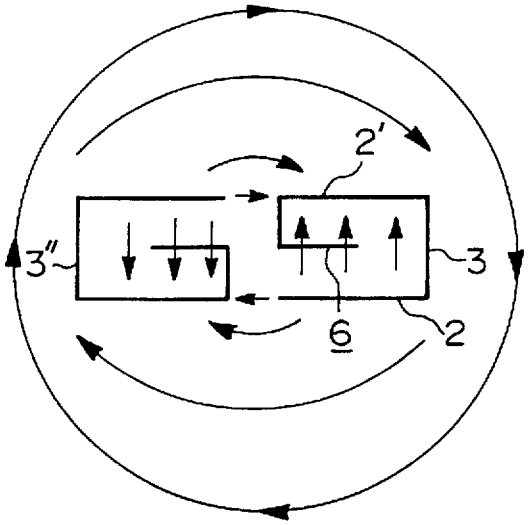
FIG. 7 is a diagram for explaining operations of the antenna apparatus of FIG. 6(*a*).

FIG. 7 is a diagram explaining the principle of the antenna apparatus of FIG. 6(*a*). A signal propagating through the coaxial line 8 enters the triplate line 6 via the coaxial connector 7. The triplate line 6 can be formed in a small size resulting in reduction in size of the antenna apparatus by filling the rectangular parallelepiped with the dielectric material 4.

Both ends of the triplate line 6 are connected respectively to the right side edge of the radiation slot 1 and the left side edge of the slot 1' with respect to FIG. 6(*b*) and a voltage is applied across the strip line 5 and the first set of the ground conductive plates 2, 2'. Since the ends of the triplate line 6 are connected to the opposite side edges of the radiation slots 1, 1', the electric fields inside the rectangular parallelepiped formed of the first set of conductive plates 2, 2' and the second set of conductive plates 3', 3", 3'" are reversed with each other as indicated by the arrow marks in FIG. 7.

Therefore, the radiation slots 1, 1' provided on the grounded conductive plates 2, 2' are excited out of phase (in a phase difference of 180 degrees). The radiation field formed by these radiation slots 1, 1' becomes continuous in the horizontal plane (azimuth direction) and a horizontally polarized omnidirectional radiation pattern can be obtained.

In the first embodiment, the radiation slots 1, 1' are fed with the triplate line 6, but another feeding line such as a coaxial line can also be used for the same purpose.

Figure 8:
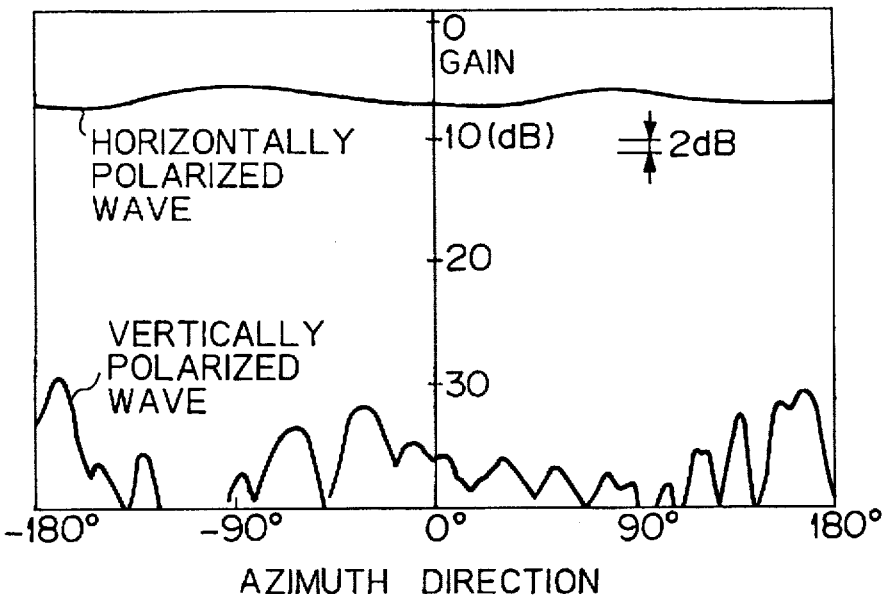
FIG. 8 is a graph illustrating a gain in the azimuth direction of the antenna apparatus of FIG. 6(*a*).

FIG. 8 indicates measured gains of horizontally polarized and vertically polarized waves when the antenna apparatus of FIG. 6(*a*) is rotated 360 degrees in the horizontal plane. As seen from FIG. 8, in the case of the horizontally polarized wave, an amount of ripple is within 2 dB, resulting in a substantially omnidirectional pattern. The gain of the vertically polarized wave which is a cross-polarized wave is −20 dB or less and a satisfactory characteristics results.

Embodiment 2

Figure 9A:
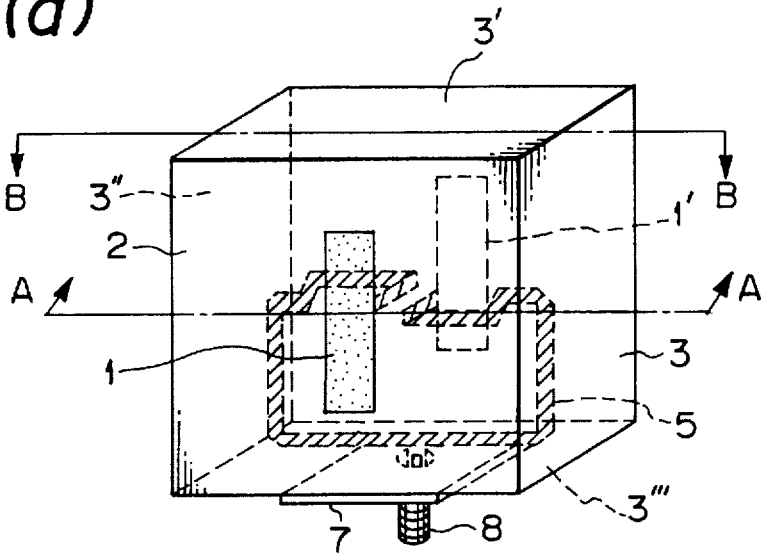
FIG. 9(*a*) is a perspective view of a second embodiment of an antenna apparatus of the present invention.
Figure 9B:
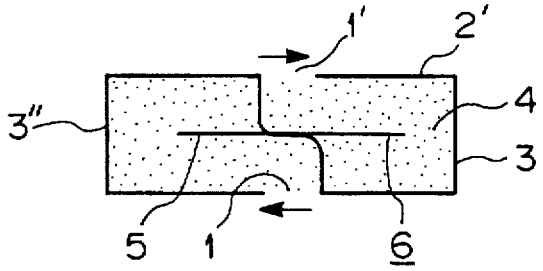
Figure 9C:
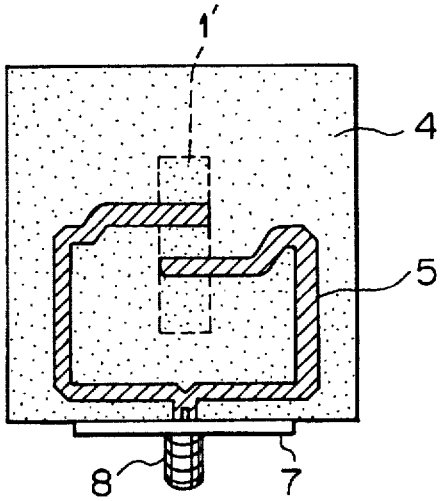

FIGS. 9(*a*)–9(*c*) schematically illustrates a configuration of the second embodiment of the present invention, FIG. 9(*a*) being perspective view, FIG. 9(*b*) a cross-sectional view taken along the line A—A and FIG. 9(*c*) a cross-sectional view taken along the line B—B. The second embodiment is different from the first embodiment in that both ends of the triplate line 6 are connected respectively to left side edge of the radiation slot 1 and the right side edge of the slot 1' with respect to FIG. 9(*b*). A voltage is applied across the radiation slots 1, 1' from the triplate line 6 for exciting the radiation slots 1, 1'. Since the radiation slots 1, 1' provided on the first set of grounded conductive plates 2, 2' are excited out of phase, a radiation field generated by these radiation slots 1, 1' becomes continuous in the horizontal plane (azimuth direction) and a horizontally polarized omnidirectional radiation pattern can be obtained. In this embodiment, the ends of the triplate line 6 are connected to the radiation slots 1, 1', but a similar characteristic can also be obtained by open-circuiting the ends of the triplate line and setting the length between the open-circuited ends and the radiation slots 1, 1' to approximately a quarter of the wavelength of an operating frequency.

Embodiment 3

Figure 10A:
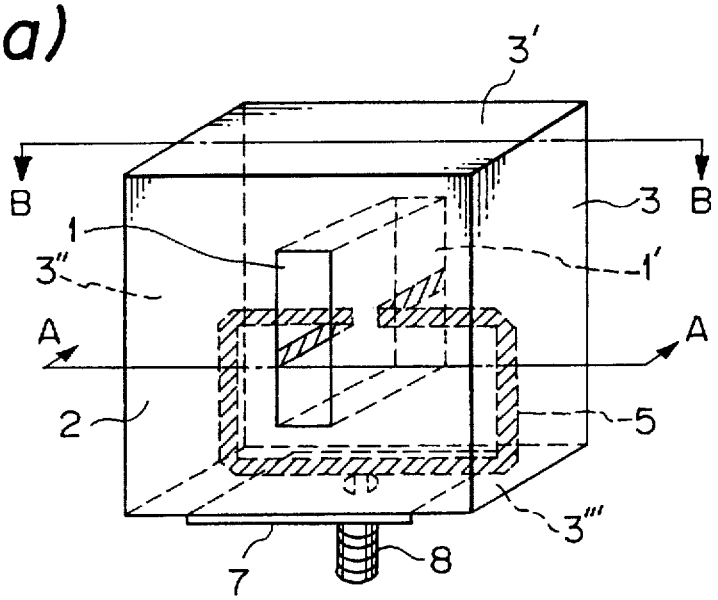
FIG. 10(*a*) is a perspective view of a third embodiment of an antenna apparatus of the present invention.
Figure 10B:
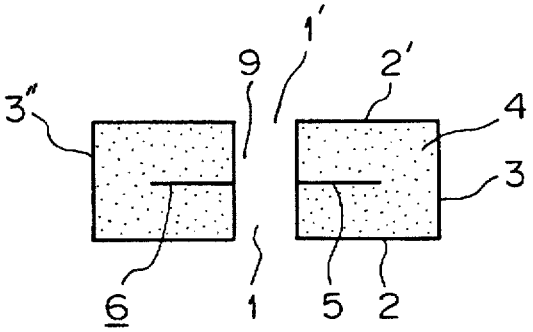
Figure 10C:
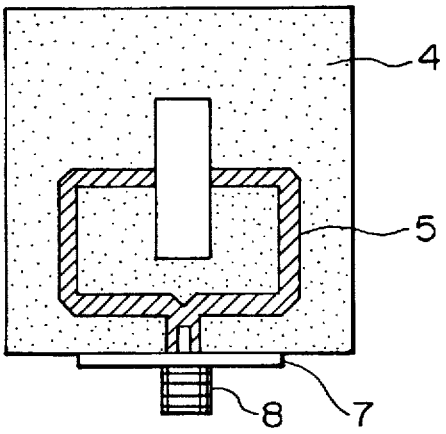

FIGS. 10(*a*)–10(*c*) schematically illustrate a configuration of the third embodiment of the present invention, FIG. 10(*a*) being a perspective view, FIG. 10(*b*) a cross-sectional view taken along the line A—A and FIG. 10(*c*) a cross-sectional view taken along the line B—B. This embodiment is different from the first embodiment in that a portion 9 of the dielectric material 4 corresponding to the radiation slots 1, 1' is removed. The antenna apparatus of this embodiment also shows, with the same principle as the antenna apparatus of the embodiment 1, a horizontally polarized omnidirectional radiation pattern. Since the portion 9 of the dielectric material 4 between the radiation slots 1, 1' formed on the first set of grounded conductive plates 2, 2' is removed, the radiation slots 1, 1' of the third embodiment must be longer, in order to have them resonate at the same resonance frequency than those of the first embodiment wherein no dielectric material 4 is removed, because a wavelength shortening effect by the dielectric material 4 is lost. The radiation slots 1, 1' being set longer, the beam width becomes narrow, the gain in the direction perpendicular to the plates 2, 2' increases and the gain in the horizontal plane can be increased. It is noted that a dielectric material may be provided in a parallelepiped defined by the radiation slots 1, 1'.

Embodiment 4

Figure 11A:
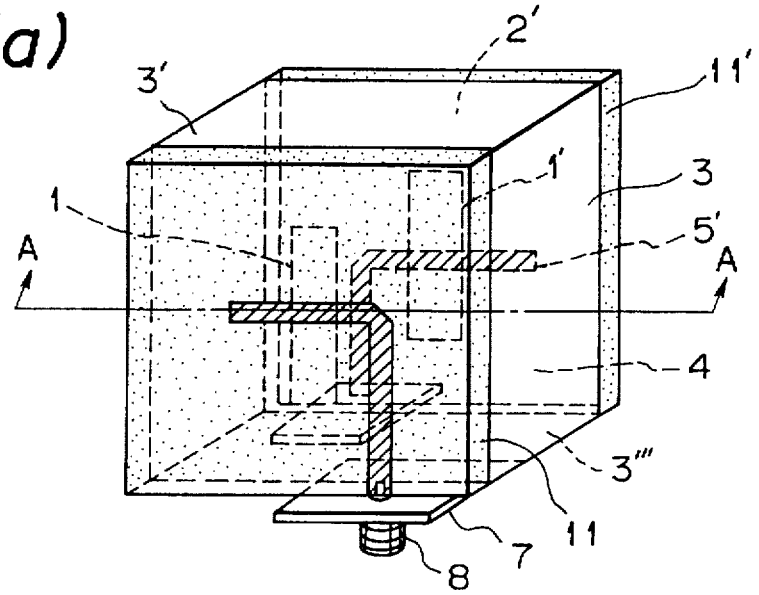
FIG. 11(*a*) is a perspective view of a fourth embodiment of an antenna apparatus of the present invention.
Figure 11B:
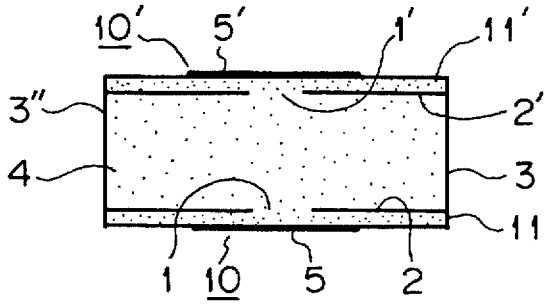
Figure 11C:
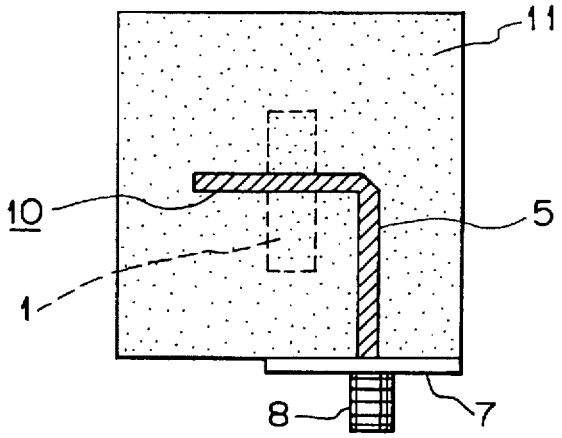

FIGS. 11(*a*)–11(*c*) schematically illustrate a configuration of the fourth embodiment of the present invention, FIG. 11(*a*) being a perspective view, FIG. 11(*b*) a cross-sectional view taken along the line A—A and FIG. 11(*c*) a side elevation.

In these figures, the strip lines 5, 5' are provided on second dielectric materials 11, 11' formed on the conductive plates 2, 2' so that microstrip lines 10, 10' are configurated by the first set of conductive plates 2, 2' and the strip conductors 5 and 5'.

Next, operations will be explained. Ends of the microstrip lines 10 and 10' are open-circuited. At the ends the electric field is maximum, while the magnetic field is minimum. Since the magnetic field becomes maximum at a position separated a quarter of the wavelength from the ends of the microstrip lines, the radiation slots 1, 1' are electromagnetically coupled with the microstrip lines 10, 10' by providing such radiation slots 1, 1' at the position described above.

Since the radiation slots 1, 1' provided on the first set of conductive plates 2, 2' are excited by the microstrip lines 10, 10' out of phase, the radiation field produced by the radiation slots 1, 1' becomes continuous in the horizontal plane (azimuth direction) and a horizontally polarized omnidirectional radiation pattern can be obtained.

In the fourth embodiment, the ends of the microstrip lines 10, 10' are open-circuited to excite the radiation slots 1, 1', but the end of each microstrip line 10, 10' can be connected to a side edge of one of the radiation slots 1, 1' using, for instance, a through hole.

Moreover, the dielectric material 4 filling the rectangular parallelepiped surrounded by the first and second sets of conductive plates can be replaced with air.

Embodiment 5

Figure 12A:
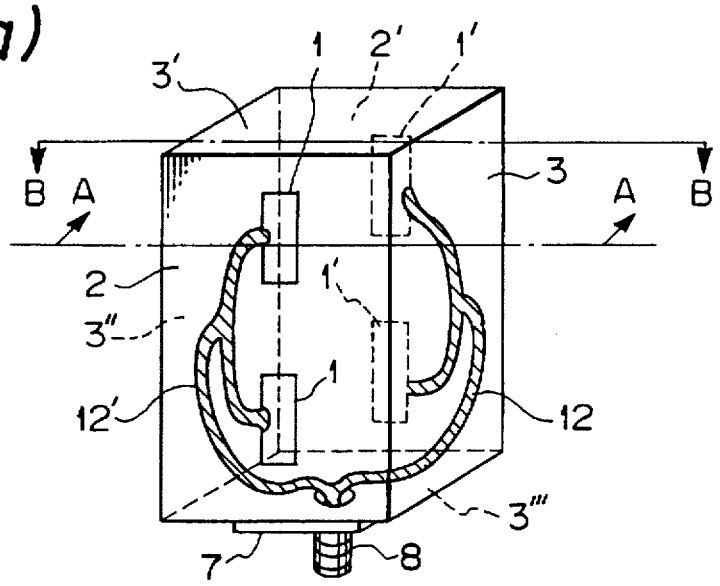
FIG. 12(*a*) is a perspective view of a fifth embodiment of an antenna apparatus of the present invention.
Figure 12B:
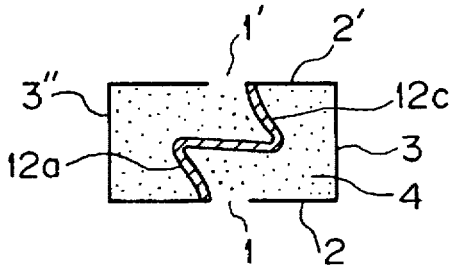
Figure 12C:
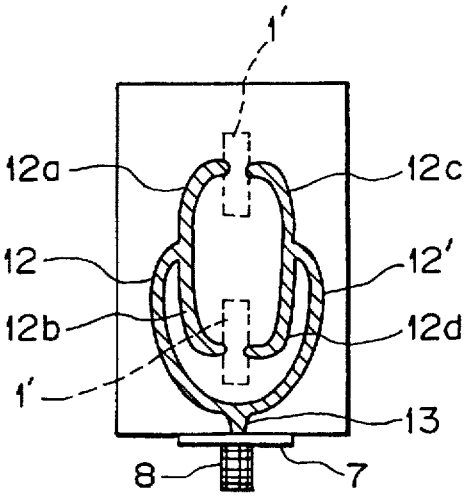

FIGS. 12(*a*)–12(*c*) schematically illustrate a configuration of the fifth embodiment of the present invention, FIG. 12(*a*) being a perspective view, FIG. 12(*b*) a cross-sectional view taken along the line A—A and FIG. 12(*c*) a side elevation. In these figures, a center conductor 13 of the signal feeding connector 7 is divided into two conductors 12, 12' which are divided respectively into two conductors 12*a*, 12*b*; 12*c*, 12*d*. The conductors 12*a*, 12*b* are each connected to a side edge of a corresponding one of the radiation slots 1, 1' provided in a vertical arrangement on the grounded conductive plate 2, while the other conductors 12*c*, 12*d* are each connected to a side edge of a corresponding one of the radiation slots 1, 1' provided in a vertical arrangement on the grounded conductive plate 2'.

A difference in length of the signal feeding lines for the adjacent radiation slots 1, 1; 1', 1' formed on the same conductive plate is an integer times the operation wavelength. Therefore, the adjacent radiation slots 1, 1 on the grounded conductive plate 2 are excited in the same phase while the radiation slots 1', 1' on the other grounded conductive plate 2' are excited out of phase.

Therefore, the electromagnetic waves radiated from the radiation slots formed on the same grounded conductive plate are in the same phase in the horizontal plane, resulting in increase in gain in the horizontal plane. Moreover, since the radiation slots 1, 1 on the conductive plate 2 are excited out of phase with respect to the radiation slots 1', 1' on the conductive plate 2', the radiation field produced by these radiation slots 1, 1; 1', 1' become continuous in the horizontal plane and a horizontally polarized omnidirectional high-gain radiation pattern can be obtained in the horizonal plane. The beam width in the vertical plane can be adjusted by changing an interval between the vertically arranged radiation slots on the same conductive plate.

The number of radiation slots formed on the same conductive plate is not limited to two and three or more radiation slots can be provided. The signal feeding line may be replaced with other lines such as a coaxial line.

Embodiment 6

Figure 13A:
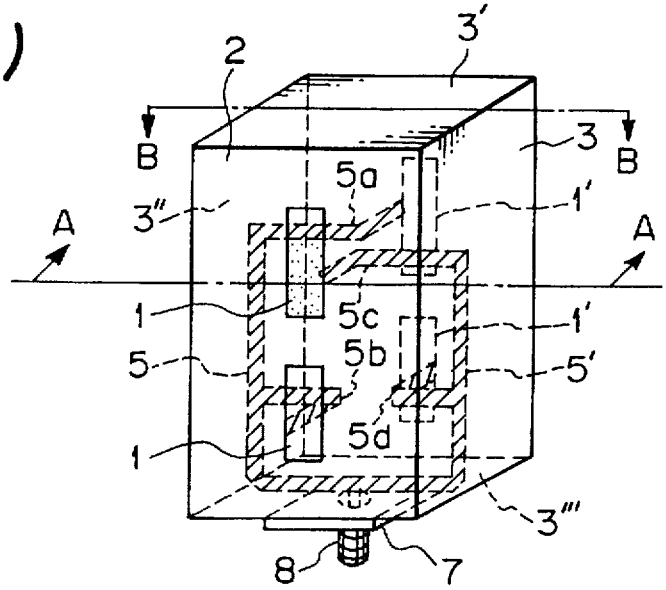
FIG. 13(*a*) is a perspective view of a sixth embodiment of an antenna apparatus of the present invention.
Figure 13B:
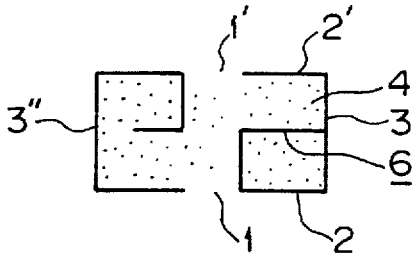
Figure 13C:
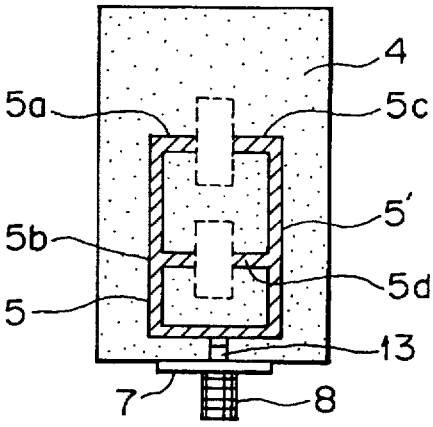

FIGS. 13(*a*)–13(*c*) schematically illustrate a configuration of the sixth embodiment of the present invention, FIG. 13(*a*) being a plan view, FIG. 13(*b*) a cross-sectional view taken along the line A—A and FIG. 13(*c*) a cross-sectional view taken along the line B—B.

In these figures, the center conductor 13 of the signal feeding connector 7 is divided into and connected to the strip lines 5, 5'. These strip lines 5, 5' are then divided into two strip lines 5*a*, 5*b*; 5*c*, 5*d*. The strip lines 5*a*, 5*d* are connected to different side edges of the radiation slots 1, 1' provided on the conductive plate 2', while the other strip lines 5*b*, 5*c* are connected to the different side edges of the radiation slots 1, 1' provided on the conductive plate 2.

In this case, a difference in length of the signal lines for the radiation slots formed on the same conductive plate is set to an odd number times a half of the wavelength. Therefore, the radiation slots 1, 1' on one conductive plate 2 are excited in the same phase, while the radiation slots on the other conductive plate are excited out of phase.

Accordingly, for the same reason as the fifth embodiment, a horizontally polarized omnidirectional high-gain radiation pattern can be obtained.

The beam width in the vertical plane can be adjusted by changing an interval of the vertically arranged radiation slots on the same conductive plate.

The number of radiation slots formed on the same conductive plate is not limited to two and three or more radiation slots can be provided. The signal feeding line may be replaced with other lines such as a coaxial line.

Embodiment 7

Figure 14A:
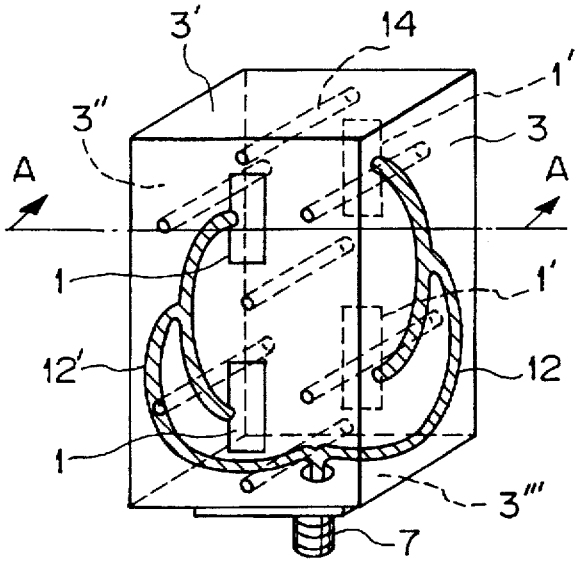
FIG. 14(*a*) is a perspective view of a seventh embodiment of an antenna apparatus of the present invention.
Figure 14B:
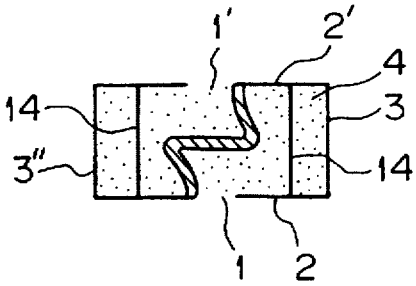

FIGS. 14(*a*)–14(*b*) schematically illustrate a configuration of the seventh embodiment of the present invention, FIG. 14(*a*) being a perspective view and FIG. 14(*b*) a cross-sectional view taken along the line A—A. This embodiment is different from the fifth embodiment in that a plurality of pins 14 for connecting the first set of grounded conductive plates 2, 2' are provided in the antenna.

The operation is the same as that explained in regard to the fifth and sixth embodiments. In this case, the periphery of the radiation slots 1, 1' is surrounded by the conductive plates 2, 2' and this configuration can be considered as a waveguide and a waveguide mode can be excited therein. If the width of the conductive plates 2, 2' is determined to be a half of the wavelength or less, only the basic mode is propagated if no connecting pin 14 is provided in the waveguide. The radiation slots 1, 1, 1', 1' formed along the center of the conductive plates 2, 2' are inherently not excited, but these radiation slots are actually excited because the internal electromagnetic field is disturbed due to the existence of the internal feeding lines 12, 12'. However, since the radiation slots are excited in the waveguide mode in a phase difference different from the case where the radiation slots are excited with the feeding line, the amplitude and phase at the radiation slots are disturbed and any omnidirectional radiation pattern cannot be obtained. In order to solve the problem, any unwanted waveguide mode is suppressed by the pins 14 connecting the conductive plates 2, 2', thereby obtaining an omnidirectional radiation pattern. In the seventh embodiment, the pins 14 are used for suppressing unwanted mode, but conductive bars or plates can be used in place of the pins 14.

Embodiment 8

Figure 15A:
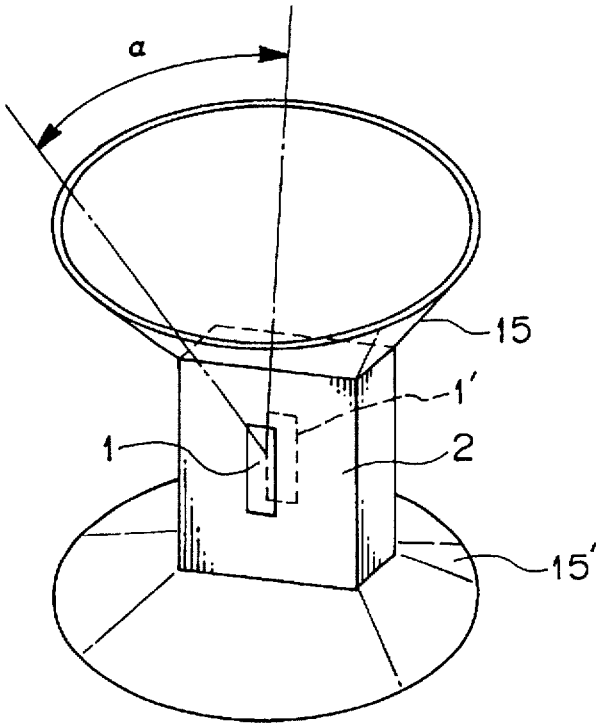
FIG. 15(*a*) is a perspective view of an eighth embodiment of an antenna apparatus of the present invention.
Figure 15B:
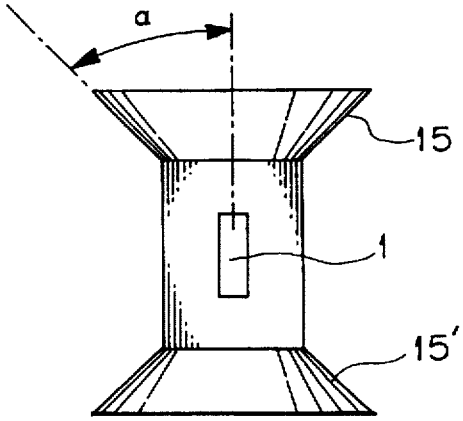

FIGS. 15(*a*) and 15(*b*) schematically illustrate a configuration of the eighth embodiment of the present invention, FIG. 15(*a*) being a perspective view and FIG. 15(*b*) a side elevation. In this embodiment horn-type metal conductors 15, 15' are coupled to upper and lower surfaces of the antenna apparatus of the first–seventh embodiments.

In this embodiment, for the same reasons as explained for the first embodiment, a horizontally polarized wave is excited omnidirectionally. If only one radiation slots 1, 1' is formed on each of the conductive plates 2, 2' like the first embodiment, there is a limitation to a change in beam width in the elevating direction and it is difficult to obtain a high gain.

Instead of vertically arranging a plurality of radiation slots on the conductive plates 2, 2' to narrow the beam width in elevation, this embodiment employs the horn-type conductors 15, 15' coupled to the upper and lower ends of the antenna apparatus described in the foregoing embodiments.

The horn-type conductors 15, 15' operate in combination like a horn antenna. Since the gain of this antenna is determined by a size of the aperture of the horn, a higher gain can be obtained by enlarging the aperture of the horn.

This means that a high gain can be obtained even if only one radiation slot is provided on each of the conductive plates 2, 2'. A slant angle $\alpha$ of the horn-type conductors 15, 15' with respect to the horizontal plane does not give any influence on an omnidirectional pattern in the horizontal plane.

The beam width and gain in the vertical plane can be easily adjusted by changing the slant angle $\alpha$.

Embodiment 9

Figure 16A:
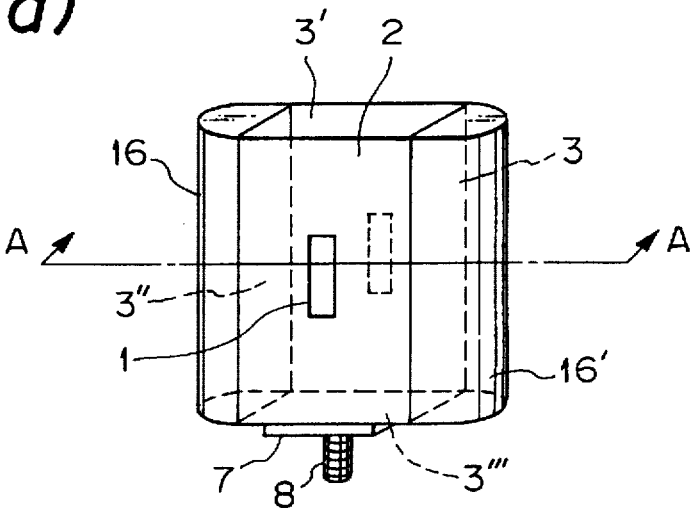
FIG. 16(*a*) is a perspective view of a ninth embodiment of an antenna apparatus of the present invention.
Figure 16B:
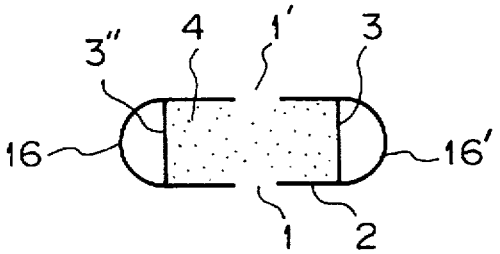
Figure 16C:
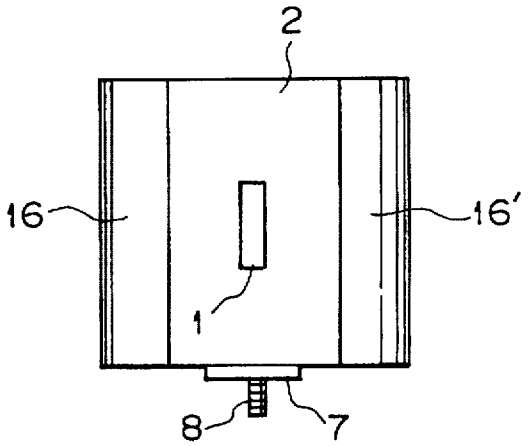

FIGS. 16(*a*)–16(*c*) schematically illustrate a configuration of the ninth embodiment of the present invention, FIG. 16(*a*) being a perspective view, FIG. 16(*b*) a cross section taken along the line A—A and FIG. 16(*c*) a side elevation. This embodiment provides a third set of conductive plates 16, 16' that electrically connect the first set of conductive plates 2, 2' of the antenna apparatus of the first embodiment.

In principle, an omnidirectional radiation pattern can be obtained if a size of the conductive plates 2, 2' is infinite. Since the conductive plates 2, 2' are limited in size, however, a ripple is generated due to the interference of waves diffracted at the edge portions of the conductive plates 2, 2'. The generated ripple changes in the period of about one wavelength depending on the size of the conductive plates 2, 2'.

Since the ripple can be minimized by changing the size of the conductor plates 2, 2', in this embodiment, the conductive plates 16, 16' are additionally provided to cover the opposing conductive plates 3, 3" of the antenna apparatus according to the first to seventh embodiments.

The third set of conductive plates 16, 16', though shown in FIG. 16(*b*) to have a semi-circular cross-section in order to change the size of the conductive plates 2, 2', can be formed to have an elliptic or rectangular cross-section. Whether the spaces between the conductive plates 3, 3" and the third set of conductive plates 16, 16' are filled with a dielectric material or not is optional.

Embodiment 10

Figure 17A:
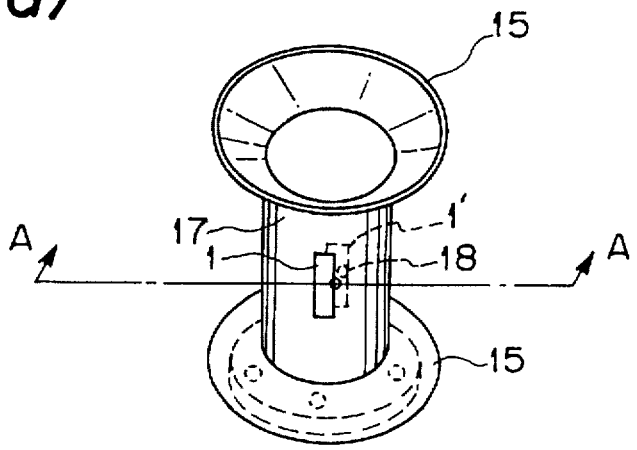
FIG. 17(*a*) is a perspective view of a tenth embodiment of an antenna apparatus of the present invention.
Figure 17B:
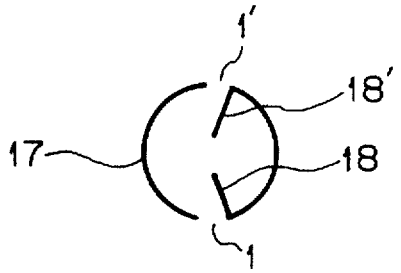
Figure 17C:
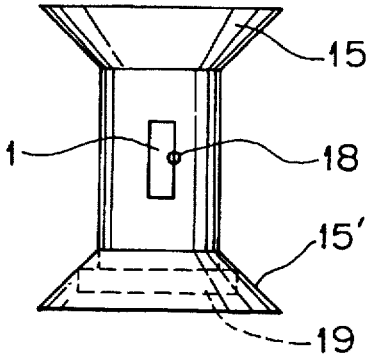

FIGS. 17(*a*)–17(*c*) schematically illustrate a configuration of the tenth embodiment of the present invention, FIG. 17(*a*) being a perspective view, FIG. 17(*b*) a cross section taken along the line A—A and FIG. 17(*c*) a side elevation.

In these figures, the radiation slots 1, 1' are formed to oppose each other on a cylindrical waveguide 17 of which both ends are short-circuited. To one side edge of each of the radiation slots 1, 1' are soldered conductive bars 18, 18'. Numeral 19 designates a waveguide flange. When the circular waveguide 17 is excited in a $TM_{01}$ mode, a current flows in the axial direction. If the radiation slots 1, 1' are provided in parallel to the axis of the waveguide 17, the radiation slots 1, 1' are not excited because the slots do not cross the current. The radiation slots 1, 1' can be excited by fixing the conductive bars 18, 18' inside the circular waveguide 17 from the side edges of the radiation slots 1, 1'. A horizontally polarized omnidirectional radiation pattern can be obtained by arranging one or more radiation slots in the circumferential direction of the cylindrical waveguide 17.

The beam width in the vertical plane can be narrowed by arranging a plurality of radiation slots in parallel to the longitudinal axis of the circular waveguide 17.

Since the radiation slots 1, 1' are excited by exciting the cylindrical conductor 17, a standing wave position deviates when an excitation frequency of the waveguide 17 changes. Then, the amplitude and phase of a signal exciting the radiation slots 1, 1' change and a radiation pattern obtained by combining radiation fields from the slots 1, 1' also changes. It is possible to provide the horn-type conductors 15, 15' as in the case of the eighth embodiment, to both ends of the circular waveguide 17 in order to obtain a narrower beam width in the vertical plane.

In this embodiment, the radiation slots 1, 1' are excited using the conductor bars 18, 18', but it is possible to excite the radiation slots 1, 1' by slanting the radiation slots 1, 1' with respect to the axis of the circular waveguide 17.

Embodiment 11

Figure 18A:
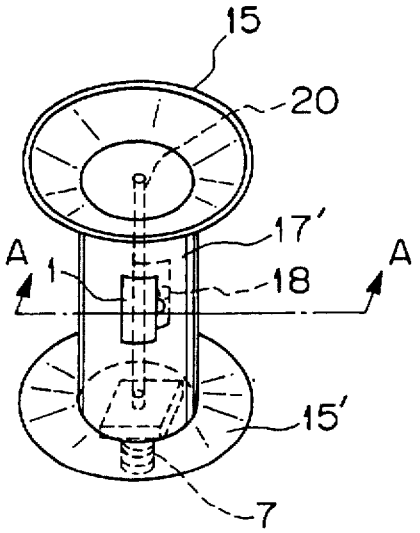
FIG. 18(*a*) is a perspective view of an eleventh embodiment of an antenna apparatus of the present invention.
Figure 18B:
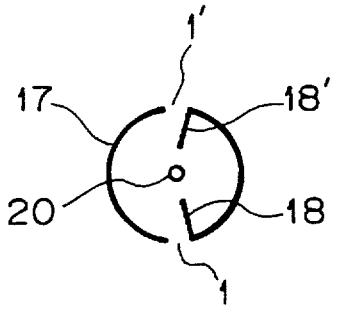
Figure 18C:
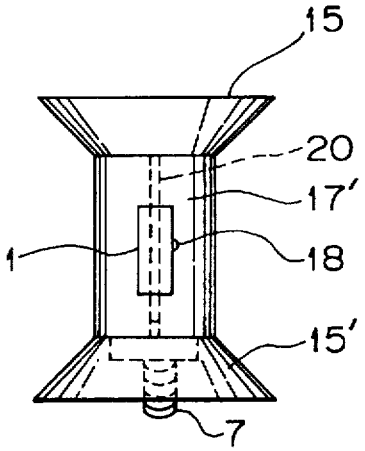

FIGS. 18(*a*)–18(*c*) schematically illustrate a configuration of the eleventh embodiment of the present invention, FIG. 18(*a*) being a perspective view, FIG. 18(*b*) a plan view taken along the line A—A and FIG. 18(*c*) a side elevation. In this embodiment a center conductor 20 is provided through the circular waveguide 17 of the tenth embodiment to form a coaxial line 17'. If the coaxial line 17' including short-circuited ends is excited in the basic mode (the magnetic field is uniform in the circumferential direction of the coaxial line 17'), a current flows in the longitudinal axial direction. If the radiation slots 1, 1' are provided in parallel to the axis of the coaxial line 17', the radiation slots 1, 1' are not excited. In order that these slots are excited, the conductor bars 18, 18' are provided to protrude inside the coaxial line 17' from the side edges of the radiation slots 1, 1'. A horizontally polarized omnidirectional radiation pattern can be obtained by providing one or more radiation slots in the circumferential direction.

In order to make the beam in the vertical direction narrower, a plurality of radiation slots may be arranged in parallel to the axis of the coaxial line 17'. Since the radiation slots 1, 1' are excited by exciting the coaxial line 17' the position of a standing wave is deviated if the excitation frequency of the coaxial line 17' is shifted. Then, the amplitude and phase of a signal for exciting the radiation slots 1, 1' change and a radiation pattern obtained by combining the radiation fields from the slots 1, 1' is also changed. In order to avoid this problem, the horn-type conductors 15, 15' may be provided, as in the case of the eighth embodiment, to both ends of the coaxial line 17' in view of obtaining a narrower beam width in the vertical direction.

Embodiment 12

Figure 19A:
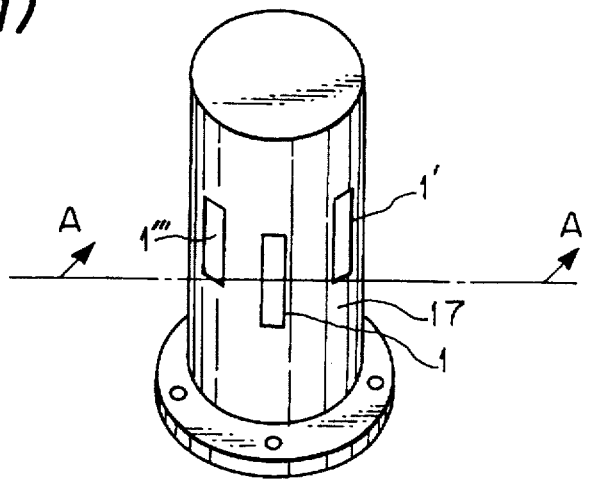
FIG. 19(*a*) is a perspective view of a twelfth embodiment of an antenna apparatus of the present invention.
Figure 19B:
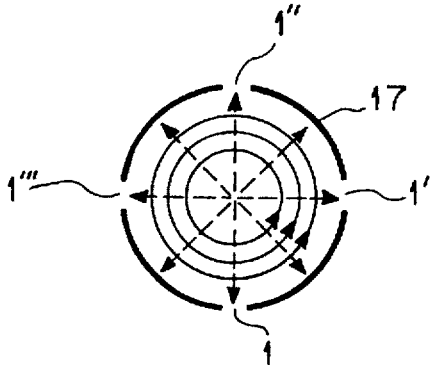
Figure 19C:
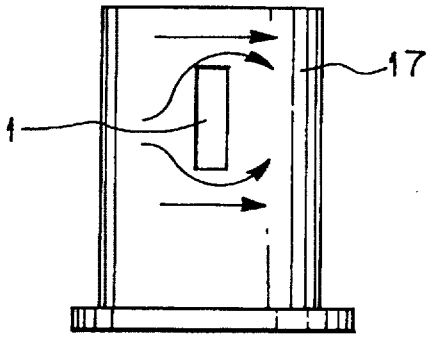

FIGS. 19(*a*)–19(*c*) schematically illustrate a configuration of the twelfth embodiment of the present invention, FIG. 19(*a*) being a perspective view, FIG. 19(*b*) showing a distribution of electromagnetic wave at the cross-section taken along the line A—A and FIG. 19(*c*) showing a distribution of current on the side surface. The cylindrical waveguide 17 is excited in the $TE_{01}$ mode and the radiation slots 1, 1', 1", 1'" are formed in the axial direction the cylindrical waveguide 17. In these figures, since the cylindrical waveguide 17 having the short-circuited ends is excited in the $TE_{01}$ mode, a current flows in the circumferential direction of the cylindrical waveguide 17 as shown in FIG. 19(*c*). Therefore, the radiation slots can easily be excited by providing the slots in parallel to the longitudinal axis of the waveguide. A horizontally polarized omnidirectional radiation pattern can be obtained by arranging one or more slots in the circumferential direction.

A beam width in the vertical direction can be narrowed by arranging a plurality of radiation slots in the longitudinal axial direction of the waveguide 17 or providing horn-type conductors at both ends of the circular waveguide 17.

Embodiment 13

Figure 20A:
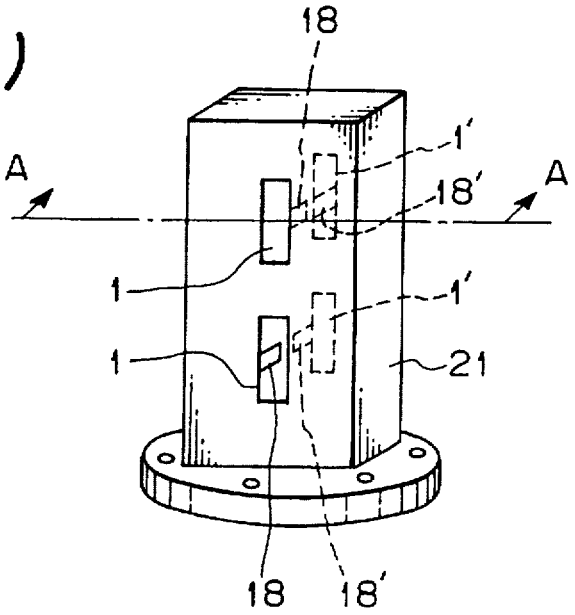
FIG. 20(*a*) is a perspective view of a thirteenth embodiment of an antenna apparatus of the present invention.
Figure 20B:
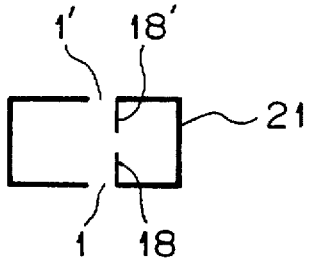
Figure 20C:
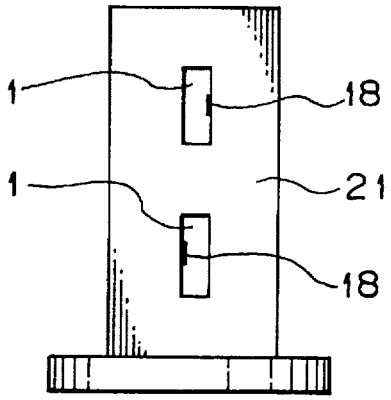

FIGS. 20(*a*)–20(*c*) schematically illustrate a configuration of the thirteenth embodiment of the present invention, FIG. 20(*a*) being a perspective view, FIG. 20(*b*) a cross-sectional view taken along the line A—A and FIG. 20(*c*) a side elevation. In this embodiment, the radiation slots 1, 1' are formed on two opposing surfaces of a rectangular waveguide 21. If the rectangular waveguide 21 having short-circuited ends is excited in the $TE_{10}$ mode, the radiation slots 1, 1' must be formed at positions offset from the longitudinal axis of the waveguide 21 for excitation. Then, a beam tilt is generated like in the prior art and a ripple in the horizontal plane becomes large.

In this embodiment, the radiation slots 1, 1' are provided in parallel with the center line of the H plane of the rectangular waveguide 21 and the conductive bars 18, 18' protruding inside the waveguide 21 are fixed to the side edges of the radiation slots 1, 1'.

The conductive bars 18, 18' establish a distribution of electromagnetic field asymmetrical with respect to the center line of the rectangular waveguide 21, whereby the radiation slots 1, 1' provided on the center line of the plane H are excited, resulting in the generation of an omnidirectional radiation pattern having no beam tilt.

Embodiment 14

Figure 21A:
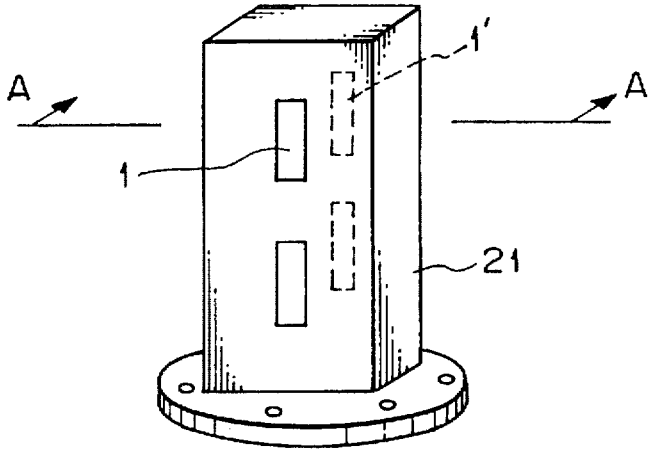
FIG. 21(*a*) is a perspective view of a fourteenth embodiment of an antenna apparatus of the present invention.
Figure 21B:
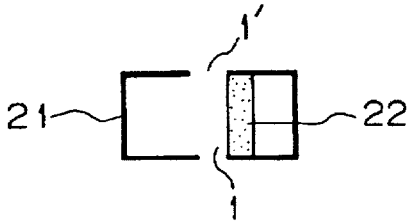
Figure 21C:
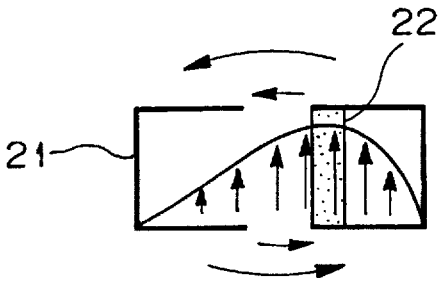

FIGS. 21(*a*)–21(*c*) schematically illustrate a configuration of the fourteenth embodiment of the present invention, FIG. 21(*a*) being a perspective view, FIG. 21(*b*) a cross-sectional view taken along the line A—A and FIG. 21(*c*) showing a distribution of electric field at the cross-section taken along the line A—A.

In this embodiment, a dielectric material 22 is fixed inside the rectangular waveguide 21 in place of the conductive bars 18, 18' used in the thirteenth embodiment.

If the rectangular waveguide 21 having short-circuited ends is excited in the $TE_{10}$ mode, the radiation slots 1, 1' must be formed at positions offset from the center of the waveguide 21 for the excitation. Then, a beam tilt is Generated like in the prior arts and a ripple in the horizontal plane becomes large.

In this embodiment, though the radiation slots 1, 1' are provided in parallel to the center line of the H plane of the rectangular waveguide 21, the dielectric material 22 is provided at the position offset from the center of the rectangular waveguide 21, whereby the radiation slots 1, 1' are excited as a result of a change in distribution of the electromagnetic field inside the rectangular waveguide 21 as shown in FIG. 21(*c*). Since the conductive bars 18, 18' are not used in this embodiment, such a process as soldering is advantageously unnecessary.

Embodiment 15

Figure 22A:
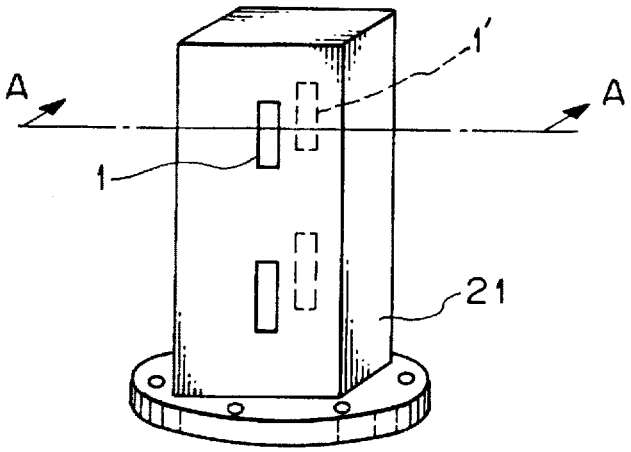
FIG. 22(*a*) is a perspective view of a fifteenth embodiment of an antenna apparatus of the present invention.
Figure 22B:
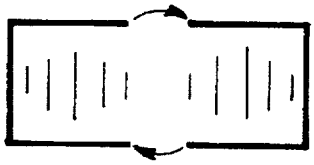

FIGS. 22(*a*) and 22(*b*) schematically illustrate a configuration of the fifteenth embodiment of the present invention, FIG. 22(*a*) being a perspective view and FIG. 22(*b*) showing a distribution of electric field at a cross-section taken along the line A—A. In this embodiment, the rectangular waveguide 21 is excited in the $TE_{20}$ mode and the ends of the rectangular waveguide 21 are short-circuited. As a result, the electromagnetic field inside the rectangular waveguide 21 becomes zero at the center of the H plane as shown in FIG. 22(*b*), whereby the radiation slots 1, 1' can be excited out of phase. The radiation field from the radiation slots 1, 1' becomes continuous in the horizontal plane and a horizontally polarized omnidirectional radiation pattern can be obtained.

Embodiment 16

Figure 23:
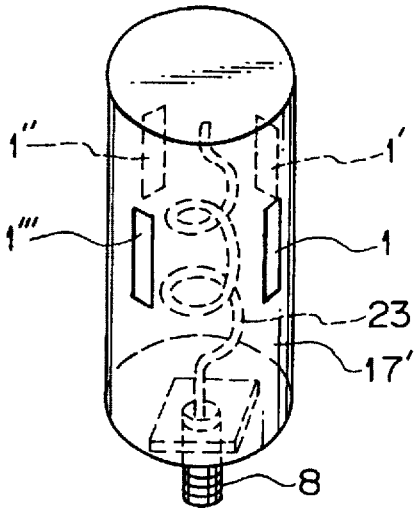
FIG. 23 is a perspective view of a sixteenth embodiment of an antenna apparatus of the present invention.

FIG. 23 schematically illustrates a configuration of the sixteenth embodiment of the present invention. In this embodiment, the radiation slots 1, 1', 1", 1'" formed on the outer conductor of the coaxial line 17' are excited by a spiral inner conductor 23.

If the coaxial line 17', the ends of which are short-circuited, is excited in the basic mode (the magnetic field is uniform in the circumferential direction of the coaxial line 17'), a current flows in the longitudinal axial direction. If the radiation slots 1, 1', 1", 1'" are provided in parallel to the longitudinal axis of the line 17', the radiation slots are not excited. In this embodiment, the spiral inner conductor 23 is used in place of the conductive bars 18, 18' used in the thirteenth embodiment and the dielectric material 22 used in the fourteenth embodiment.

The spiral inner conductor 23 enables a current to flow through the outer conductor slantly with respect to the longitudinal axis, and the radiation slots 1, 1', 1", 1'" provided in parallel to the longitudinal axis can be excited. A horizontal polarization omnidirectional radiation pattern can be obtained by arranging one or more radiation slots in the circumferential direction of the coaxial line 17'.

In order to reduce a beam width in the vertical plane, a plurality of radiation slots may be arranged in the longitudinal axial direction of the coaxial line 17' or horn-type conductors can be provided as explained in the eleventh embodiment. The whole part or a part of the inner conductor 23 may be formed in spiral and the end of the inner conductor 23 may be open-or short-circuited.

Embodiment 17

Figure 24A:
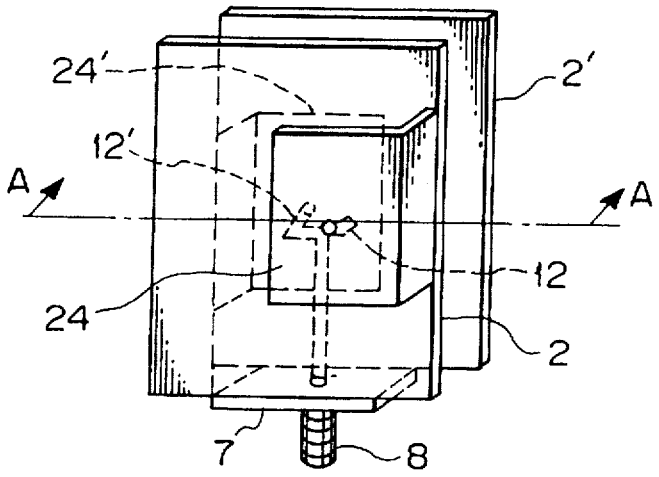
FIG. 24(*a*) is a perspective view of a seventeenth embodiment of an antenna apparatus of the present invention.
Figure 24B:
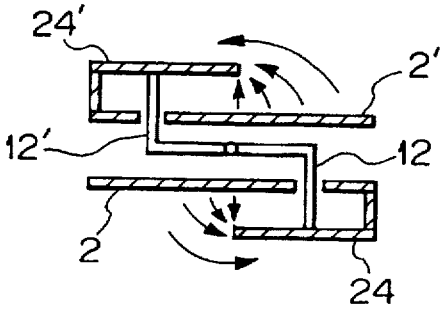

FIGS. 24(*a*) and 24(*b*) schematically illustrate a configuration of the seventeenth embodiment of the present invention, FIG. 24(*a*) being a perspective view and FIG. 24(*b*) showing a cross-sectional view taken along the line A—A and a distribution of electric field thereat. In these figures, one side edge of each of patch conductors 24, 24' is short-circuited to a corresponding edge of the conductive plate 2, 2' to form a microstrip antenna.

In an ordinary microstrip antenna, the inner electric field is not disturbed even if a barrier (termination conductor) is provided at the position where the inner field becomes zero. The microstrip antenna according to the present embodiment can be formed by dividing the ordinary microstrip antenna into two sections with a short-circuiting conductor and using one of the two sections as an antenna. A wave polarized perpendicularly to the short-circuiting conductor is generated as in the microstrip antenna by feeding the antenna at a position perpendicular to the short-circuiting conductor.

Therefore, as clearly shown in FIG. 24(*b*), a pair of microstrip antennas of the same shape having the patch conductors 24, 24' are arranged in such a manner that the conductive plates 2, 2' are parallel with each other, that both microstrip antennas face in opposite directions, and that the two patch conductors 24, 24' are fed out of phase. As a result, the produced radiation field becomes continuous in the horizontal plane (azimuth direction) and an omnidirectional radiation pattern can be obtained.

Embodiment 18

Figure 25A:
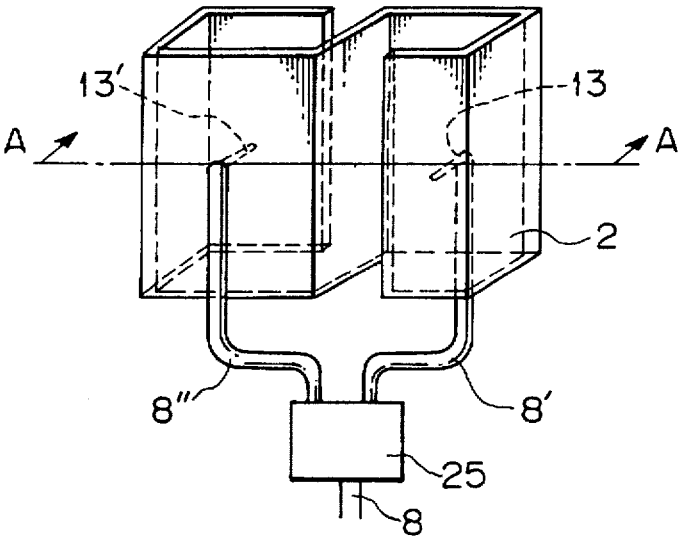
FIG. 25(*a*) is a perspective view of an eighteenth embodiment of an antenna apparatus of the present invention.
Figure 25B:
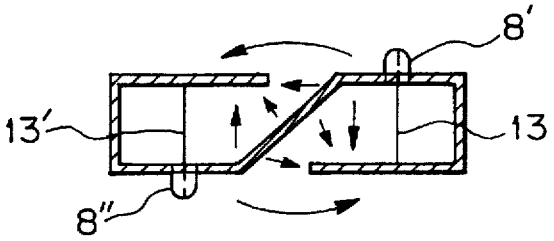

FIGS. 25(*a*) and 25(*b*) schematically illustrate a configuration of the eighteenth embodiment of the present invention, FIG. 25(*a*) being a perspective view of and FIG. 25(*b*) showing a distribution of electric field in a cross-sectional view taken along the line A—A. In these figures, the grounded conductive plate 2 is formed to have a figure-S type and excited with the coaxial lines 8', 8" which are divided from the coaxial line 8 through a divider 25.

The earth conductive plate is folded at both end portions in opposite directions and the folded portions are then further folded at both end portions. The further folded portions form patch conductors of each of which one side edge is short-circuited. These patch conductors are fed out of phase with the coaxial line 8', 8".

Thus, two microstrip antennas are configurated equivalently.

Therefore, the radiation field becomes continuous in the horizontal plane (azimuth direction) and an omnidirectional radiation pattern can be obtained by feeding the two patch conductors out of phase as in the seventeenth embodiment.

Embodiment 19

Figure 26A:
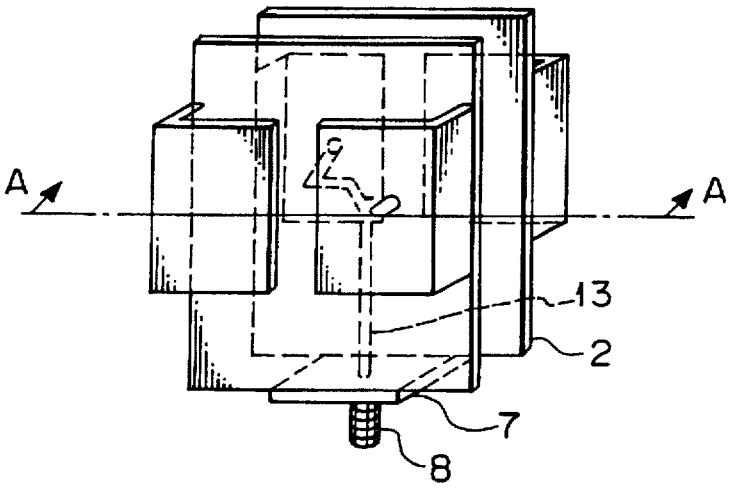
FIG. 26(*a*) is a perspective view of a nineteenth embodiment of an antenna apparatus of the present invention.
Figure 26B:
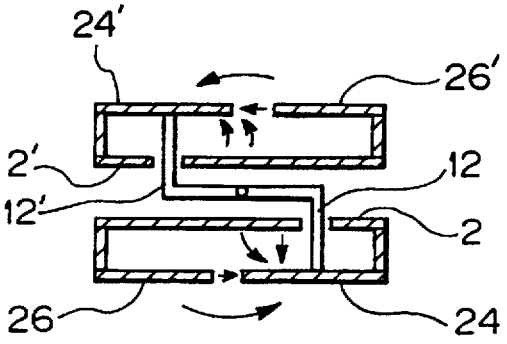

FIGS. 26(*a*) and 26(*b*) schematically illustrate a configuration of the nineteenth embodiment of the present invention, FIG. 26(*a*) being a perspective view and FIG. 26(*b*) showing a distribution of electric field in a cross-section taken along the line A—A. This embodiment provides a configuration that non-excited second patch conductors 26, 26' are added to the antenna apparatus of the seventeenth embodiment and one side edge of each of the patch conductors 26, 26' is short-circuited to a corresponding one of the conductive plates 2, 2'.

The antenna apparatus shown in FIG. 26(*a*) can provide an omnidirectional radiation pattern as in the seventeenth and eighteenth embodiments. As shown in FIGS. 26(*a*) and 26(*b*), a pair of microstrip antennas of the same shape having the patch conductors 24, 24', 26, 26' are arranged in such a manner that the grounded conductive plates 2, 2' are disposed in parallel with each other, that both of the microstrip antennas face in opposite directions, and that the patch conductors 24, 24' are fed out of phase with respect to each other. The non-excited patch conductors 26, 26' are provided on the grounded conductive plates 2, 2' so as to face corresponding patch conductors 24, 24' to form a symmetrical antenna apparatus.

The radiation field becomes continuous in the horizontal plane (azimuth direction) by exciting the two microstrip antennas out of phase. Since the antenna apparatus of the seventeenth embodiment has an asymmetrical configuration as shown in FIG. 24(*b*), ripples appear in the horizontal plane. In order to make the antenna apparatus bisymmetrical, the second patch conductors 26, 26' of the same shape are provided as shown in FIG. 26(*b*). The thus structured antenna apparatus has a symmetrical configuration and can improve a directivity in the horizontal plane.

Embodiment 20

Figure 27A:
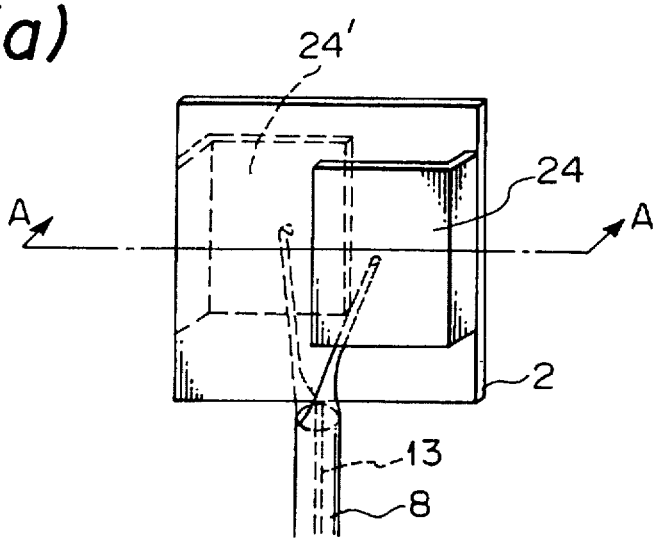
FIG. 27(*a*) is a perspective view of a twentieth embodiment of an antenna apparatus of the present invention.
Figure 27B:
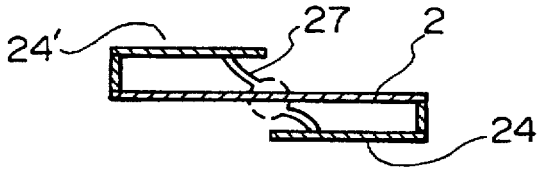
Figure 27C:
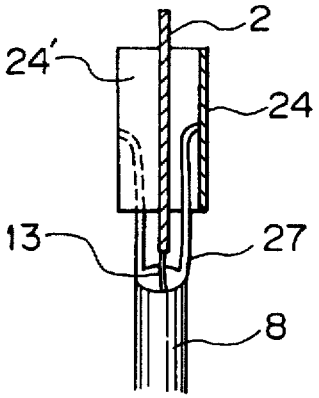

FIGS. 27(*a*)–27(*c*) schematically illustrate a configuration of the twentieth embodiment of the present invention, FIG. 27(*a*) being a perspective view, FIG. 27(*b*) a cross-sectional view taken along the line A—A and FIG. 27(*c*) a side elevation.

In these figures, the patch conductors 24, 24' are provided on both surfaces of the conductive plate 2, and the inner conductor 13 of the coaxial line 8 is connected to the conductive plate 2, while an outer conductor 27 of the coaxial line 8 to the patch conductors 24, 24'.

If the conductive plate 2 is used in common and two radiating conductors to be fed exist as indicated in the seventeenth–nineteenth embodiments, the inner conductor 13 of the coaxial feeding line 8 must be divided into two sections, resulting in a complicated configuration. In this embodiment, the outer conductor 27 of the coaxial line 8 is divided into two sections, the radiating conductors (patch conductors 24, 24') are excited and the inner conductor 13 is connected to the conductive plate 2. The thus configured antenna apparatus operates in the same manner as in the case where the inner conductor 13 is divided into two sections, and the feeding circuit may be simplified.

Embodiment 21

Figure 28:
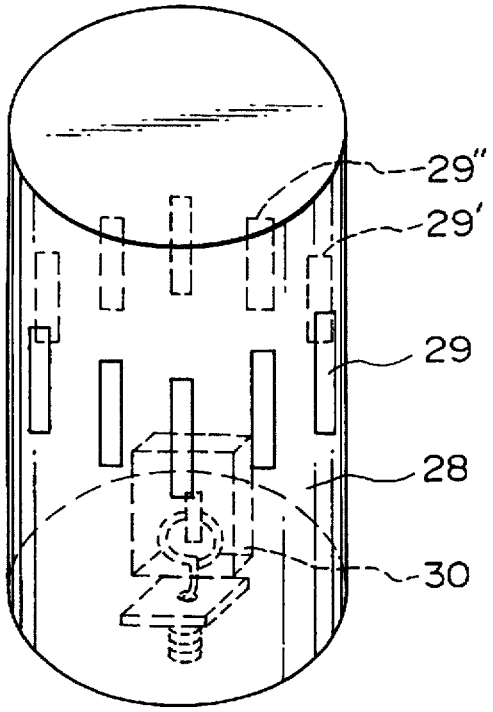
FIG. 28 is a perspective view of a twenty-first embodiment of an antenna apparatus of the present invention.

FIG. 28 schematically illustrates a configuration of the twenty-first embodiment of the present invention. In this figure, a radome 28 has radiation slots 29, 29', 29", . . . and accommodates any one of the omnidirectional antennas 30 described in the foregoing embodiments.

In general, if a radome is used to protect an antenna apparatus, the radiation pattern is influenced to a certain degree by the radome even if the radome is transparent to an electromagnetic wave.

To solve this problem, this embodiment employs the radome 28 comprising a cylindrical cover of a dielectric material and a conductive film formed on the inner surface of the cylindrical cover, radiation slots 29, 29', 29", . . . being formed on the conductive film in order to reradiate the electromagnetic wave to obtain an omnidirectional radiation pattern. Since a plurality of radiation slots are provided in the circumferential direction of the radome 28, an omnidirectional radiation pattern can be obtained without any influence given by the radome 28.

It is noted that, a plurality of radiation slots may be arranged along the longitudinal axis of the radome 28 and dipole antennas may be used in place of the slots.

Embodiment 22

Figure 29:
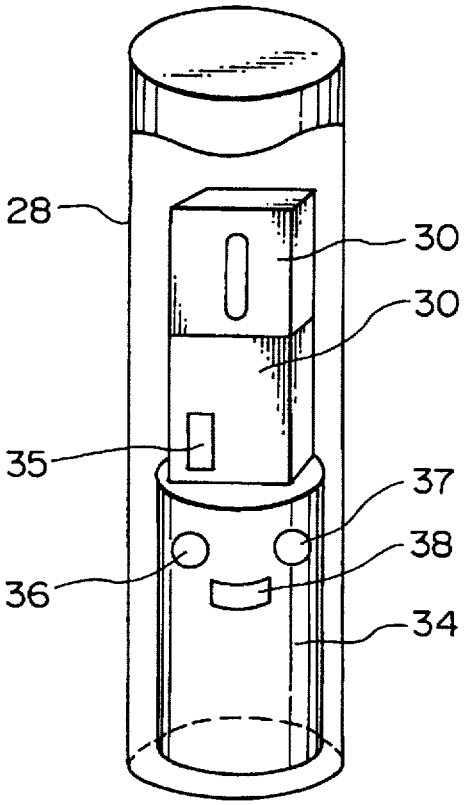
FIG. 29 is a perspective view of a transponder utilizing any one of the first to twentieth embodiments of the antenna apparatus of the present invention.

FIG. 29 schematically illustrates a configuration of a transponder comprising a transceiver, any one of the omnidirectional antenna apparatus 30 according to the present invention described heretofore, a transceiver 33, a battery 34 and the radome 28. The transponder comprises a switch 35, an indicator 36 for indicating that the transceiver 33 is waiting for a signal received, an indicator 37 for indicating that the transceiver 33 is transmitting a signal and an indicator 38 for indicating a level of received signal. The transponder can improve a man-machine relation within a limit of a predetermined volume and weight by utilizing the omnidirectional antenna which is designed smaller than a conventional waveguide slot antenna. The transponder of this embodiment makes particular contribution to the improvement in relation between an operator and the machine when emergent signal transmission is required.

In order to prevent an operator who is to transmit an emergency signal from forgetting to turn ON the switch 35, the transponder is provided with the indicator 35 as a means for informing that the transceiver 33 can receive a signal and transmit a response, that is, that the transceiver has been activated and is waiting for reception of a signal.

The transponder is provided with the indicator 37 as a means for informing an operator that the transceiver has been activated and is transmitting a signal, whereby the operator can confirm that the transponder is correctly operating.

In addition, the transponder is provided with the indicator 38 as a means for enabling an operator to monitor a level of received signal, thereby confirming whether or not a searching plane is coming closer.

The invention has been described in detail with particular reference to preferred embodiments thereof, but it will be understood that variations and modifications can be effected within the spirit and scope of the invention.

What is claimed is:

1. An antenna apparatus including:

a grounded conductive hollow body having a first radiation slot disposed in a wall of the grounded conductive hollow body, and a second radiation slot disposed in a wall opposite to the first radiation slot, each of the first and second radiation slots being aligned with a plane parallel to an axis of the grounded conductive hollow body; and a signal feeding line, having a first branch coupled to said first radiation slot and a second branch coupled to said second radiation slot, the signal feeding line exciting the first radiation slot out of phase with respect to the second radiation slot to form an omnidirectional pattern outside and extending about the antenna apparatus in a plane transverse to the axis of said grounded conductive hollow body;

wherein said hollow body includes a rectangular waveguide having radiation slots formed on the center line of the H planes of said rectangular waveguide and a member for disturbing a distribution of an electromagnetic field in said rectangular waveguide.

2. An antenna apparatus recited in claim 1, wherein said hollow body is a rectangular hollow body formed of conductive plates, said radiation slots being formed on the opposing conductive plates and excited by the signal feeding line out of phase.

3. An antenna apparatus recited in claim 2, wherein said rectangular hollow body is filled at least partially with a dielectric material.

4. An antenna apparatus recited in claim 3, wherein the dielectric material has a through-hole formed between said radiation slots.

5. An antenna apparatus recited in claim 2, wherein said signal feeding line is electromagnetically coupled with said radiation slots whereby said radiation slots are excited by said signal feeding line out of phase.

6. An antenna apparatus recited in claim 2, wherein a plurality of radiation slots are provided along the longitudinal axis of said hollow body, said radiation slots formed on the opposing conductor plates being excited out of phase and said radiation slots formed on the same conductor plate being excited in phase.

7. An antenna apparatus recited in claim 6, wherein a difference in length of signal feeding lines for feeding adjacent said radiation slots formed on the same conductive plate is set to be an integer times an operating wavelength.

8. An antenna apparatus recited in claim 6, wherein a difference in length of signal feeding lines for feeding adjacent said radiation slots on the same conductive plate is set to be an odd number times a half of an operating wavelength.

9. An antenna apparatus recited in claim 2, further comprising at least one conductive bar disposed between areas adjacent said radiation slots to connect said opposing conductive plates.

10. An antenna apparatus recited in claim 2, further comprising horn-type conductor plates, coupled to the conductive plates and disposed perpendicular to the longitudinal axis of said rectangular hollow body.

11. An antenna apparatus recited in claim 2, further comprising semi-cylindrical conductor plates respectively mounted to the conductive plates parallel to the longitudinal axis of said hollow body for the purpose of reducing any influence of waves diffracted at the edges of the conductive plates.

12. An antenna apparatus recited in claim 2, further comprising dielectric material layers formed on said opposing conductive plates and signal feeding lines provided on said dielectric material layers.

13. An antenna apparatus recited in claim 1, wherein said member includes conductive bars each fixed to one side edge of a corresponding one of said radiation slots.

14. An antenna apparatus recited in claim 1, wherein said member is a dielectric material mounted at a position deviated form the center line of said rectangular waveguide.

15. An antenna apparatus recited in claim 1, wherein said rectangular waveguide is excited in the $TE_{20}$ mode.

16. The apparatus of claim 1, further comprising a radome surrounding the grounded conductive body, the radome including a plurality of radiation elements that receive the omnidirectional patter from the grounded conductive body and transmit the omnidirectional pattern outside of the radome.

17. An antenna apparatus comprising:

an omnidirectional antenna that provides a omnidirectional beam; and a radome, surrounding the omnidirectional antenna the radome including a plurality of radiation elements that receive the omnidirectional beam and transmit the omnidirectional beam outside of the radome in an omnidirectional pattern, wherein the plurality of radiation elements includes a plurality of slots disposed on the surface of the radome.

18. The apparatus of claim 17, wherein the radome includes:

a cylindrical cover made of a dielectric material; and a conductive film formed on an inner surface of the cylindrical cover, the plurality of slots being formed through the cylindrical cover and the conductive film from an outer surface of the radome through to an inner surface of the radome.

19. An antenna apparatus comprising:

a waveguide having a first radiation slot and a second radiation slot, each disposed substantially parallel to a longitudinal axis of the waveguide; and a feeding line, receiving an input signal, the feeding line terminating at an edge of the first radiation slot, the feeding line exciting the first radiation slot and the second radiation slot at different phases with respect to one another;

wherein the signal causes the waveguide to be excited in a waveguide mode that is different from direct excitation of the first and second radiation slots provided by the feeding line, the apparatus further comprising at least one pin positioned transverse with respect to an axis of the waveguide to suppress the waveguide mode.

20. The antenna apparatus of claim 19, wherein:

the first radiation slot has a first side disposed opposite to the first side of the second radiation slot;

the first radiation slot further has a second side disposed opposite to a second side of the second slot;

a first branch of the feeding line is connected to the first side of the first radiation slot to generate a first electric field from the first side of the first radiation slot to the second side of the first radiation slot; and a second branch of the feeding line is connected to the second side of the second radiation slot to generate a second electric field, from the first side of the second radiation slot to the second side of the second radiation slot, that is opposite in polarity with respect to the first electric field, to create a substantially omnidirectional radiation pattern.

21. The antenna apparatus of claim 19, wherein the waveguide is filled at least partially with a dielectric material.

22. The antenna apparatus of claim 19, wherein the waveguide includes a first portion and a second portion, the first portion being a volume between the first and second radiation slots, only the second portion being filled with a dielectric material.

23. The antenna apparatus of claim 19, wherein the waveguide is a rectangular waveguide including a first pair of parallel conductive plates and a second pair of parallel conductive plates disposed perpendicular to the first pair of parallel conductive plates, each of the first pair of parallel conductive plates including a respective one of the first and second radiation slots.

24. The antenna apparatus of claim 23, further comprising:

a first semicircular conductive plate that connects together a first edge of each of the first pair of parallel conductive plates; and a second semicircular conductive plate that connects together a second edge of each of the first pair of parallel conductive plates.

25. The antenna apparatus of claim 19, wherein:

the waveguide further has a third radiation slot disposed below the first radiation slot, and a fourth radiation slot disposed below the second radiation slot and substantially opposite to the third radiation slot;

a first branch of the feeding line is operatively coupled to the first and third radiation slots and a second branch of the feeding line is operatively coupled to the second and fourth radiation slots, the first branch and second branch having different lengths so that the first and third radiation slots are excited substantially out of phase with respect to the second and fourth radiation slots.

26. The antenna apparatus of claim 19, wherein:

the waveguide further has a third radiation slot disposed below the first radiation slot, and a fourth radiation slot disposed below the second radiation slot and substantially opposite to the third radiation slot; and a first branch of the feeding line is operatively coupled to the first radiation slot, an extension of the first branch being operatively coupled to the third radiation slot, a second branch of the feeding line is operatively coupled to the second radiation slot, an extension of the second branch being operatively coupled to the fourth radiation slot, the first extension and the second extension being sized so that the first and third radiation slots are excited in phase with respect to each other and out of phase with respect to the second and fourth slots.

27. The antenna apparatus of claim 26, wherein the first extension has a length substantially equal to an odd number multiplied times a half of a wavelength of the signal.

28. The antenna apparatus of claim 19, further comprising:

a first horn conductor disposed on a first side of the waveguide; and a second horn conductor disposed on a second side of the waveguide opposite to the first side, the first and second horns shaping the substantially omnidirectional radiation pattern.

* * * * *